US010675874B2

(12) United States Patent
Moriyama et al.

(10) Patent No.: US 10,675,874 B2
(45) Date of Patent: Jun. 9, 2020

(54) LIQUID EJECTION DEVICE

(71) Applicant: SEIKO EPSON CORPORATION, Tokyo (JP)

(72) Inventors: Ryuji Moriyama, Matsumoto (JP); Hisayuki Akahane, Matsumoto (JP); Makoto Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/789,180

(22) Filed: Oct. 20, 2017

(65) Prior Publication Data

US 2018/0126744 A1 May 10, 2018

(30) Foreign Application Priority Data

Nov. 4, 2016 (JP) ..... 2016-215976

(51) Int. Cl.
*B41J 2/175* (2006.01)
*B41J 29/02* (2006.01)
*B41J 29/13* (2006.01)

(52) U.S. Cl.
CPC ..... *B41J 2/17509* (2013.01); *B41J 2/1752* (2013.01); *B41J 2/17506* (2013.01); *B41J 29/02* (2013.01); *B41J 29/13* (2013.01)

(58) Field of Classification Search
CPC ..... B41J 2/17503; B41J 2/17506; B41J 2/17509; B41J 2/1752; B41J 29/02; B41J 29/13
See application file for complete search history.

(56) References Cited

U.S. PATENT DOCUMENTS

2005/0195253 A1* 9/2005 Iijima ..... B41J 2/1752 347/84
2013/0169720 A1* 7/2013 Nakamura ..... B41J 2/175 347/86
2015/0360476 A1* 12/2015 Osakabe ..... H05K 999/99 347/85
2016/0207321 A1 7/2016 Osakabe
2017/0120609 A1* 5/2017 Kimura ..... B41J 2/17509
2017/0120617 A1* 5/2017 Matsumura ..... B41J 2/17509
2018/0093489 A1* 4/2018 Shirono ..... B41J 2/175

FOREIGN PATENT DOCUMENTS

CN 207359885 5/2018
JP 2008-018697 A 1/2008
JP 2016-000505 A 1/2016
JP 2016-132165 A 7/2016

* cited by examiner

*Primary Examiner* — Alessandro V Amari
*Assistant Examiner* — Kendrick X Liu
(74) *Attorney, Agent, or Firm* — Workman Nydegger

(57) ABSTRACT

A printer 1 serving as a liquid ejection device includes: a device body 2 including a recording head 20 that ejects ink; a scanner unit 3 that closes and opens at least a portion of an upper portion of the device body 2; and a plurality of ink tank 10 that are provided in the device body 2, each contain ink to be supplied to the recording head 20, and each include an ink injection port 26 through which the ink can be injected from a liquid supply container. At least one of the plurality of ink injection ports 26 is located inside an opening and closing region that is opened and closed by the scanner unit 3, and the other ink injection ports 26 are located outside the opening and closing region.

9 Claims, 19 Drawing Sheets

LIQUID EJECTION DEVICE

The present application claims priority from Japanese Patent Application No. 2016-215976 filed on Nov. 4, 2016, the contents of which are hereby incorporated by reference into this application.

BACKGROUND

1. Technical Field

The present invention relates to a liquid ejection device that ejects a liquid.

2. Related Art

Some inkjet printers, which are examples of a liquid ejection device, include a recording head for ejecting ink, which is a liquid, onto a recording medium to perform recording, and a liquid container portion that contains ink that is supplied to the recording head, and the liquid container portion can be refilled with ink that is consumed when recording is performed (JP-A-2016-132165, for example).

A printer unit 11 in a multifunction peripheral 10 described in JP-A-2016-132165 includes, inside a casing 14, an ink tank 100 (corresponding to the liquid container portion) that can be refilled with ink at a position outside a conveyance path 65 (on a right side in FIG. 1 in JP-A-2016-132165) and on a front surface side (on a near side in FIG. 1 in JP-A-2016-132165) of the casing 14.

When a cover 70 provided at a side wall on the front surface side of the casing 14 is opened, an injection port 50 of the ink tank 100 appears.

Incidentally, there are cases where, in liquid ejection devices including the inkjet printer, an opening and closing body that opens and closes relative to the device body is provided in an upper portion of the device body.

For example, in the multifunction peripheral 10 in JP-A-2016-132165, a flatbed scanner (no reference sign), which is an opening and closing body that opens and closes relative to the printer unit 11, is provided in an upper portion of the printer unit 11, which is a device body.

Here, if refilling of a liquid to the liquid container portion is started in a state in which the opening and closing body is opened, for example, there is a risk of the opening and closing body being unintentionally closed while the refilling of liquid is performed, and the opening and closing body coming into contact with a liquid supply container that is attached to the liquid container portion.

In the multifunction peripheral 10, the injection port 50 of the ink tank 100 is located outside a region that is opened and closed by the flatbed scanner, and therefore the risk of the flatbed scanner coming into contact with the liquid supply container that is attached to the injection port 50 when the ink tank 100 is refilled with ink is small, but the size of the device increases.

SUMMARY

An advantage of some aspects of the invention is to provide a liquid ejection device in which, when a liquid supply container is attached to an injection port of a liquid container portion, and the liquid container portion is refilled with a liquid, the risk of an opening and closing body coming into contact with the liquid supply container is reduced while an increase in size of the device is suppressed.

A liquid ejection device according to a first aspect of the invention includes: a device body including a liquid ejection unit that ejects a liquid; a first opening and closing body that closes and opens at least a portion of an upper portion of the device body; and a plurality of liquid container portions that are provided in the device body, each contain the liquid to be supplied to the liquid ejection unit, and each include an injection port through which the liquid can be injected from a liquid supply container. At least one of the plurality of injection ports is located inside an opening and closing region that is opened and closed by the first opening and closing body, and the other injection ports are located outside the opening and closing region.

According to the aspect, since at least one injection port of the plurality of injection ports is located in an opening and closing region that is opened and closed by the first opening and closing body, the liquid container portions can be provided in a space-saving manner. Also, since the other injection ports are located outside the opening and closing region, the risk of liquid leaking out while the liquid supply container is attached to the injection port and the liquid container portion is refilled with the liquid can be reduced, the leakage of the liquid being caused by the first opening and closing body directly coming into contact with the liquid supply container and the liquid supply container coming off from the injection port. Therefore, the liquid container portion can be stably refilled with a liquid.

A liquid ejection device according to a second aspect of the invention includes, in the first aspect, a second opening and closing body that opens and closes a portion above the injection ports.

According to the aspect, functions and effects similar to those in the first aspect can be obtained in the liquid ejection device including the second opening and closing body that opens and closes a portion above the injection ports.

In a liquid ejection device according to a third aspect of the invention, in the second aspect, the second opening and closing body includes a contact portion that can come into contact with the first opening and closing body, and abuts against the first opening and closing body at the contact portion when the second opening and closing body is in an open state such that the first opening and closing body is kept at an opening angle so as to be distanced from the liquid supply container that has been attached to the injection port.

According to the aspect, the second opening and closing body includes a contact portion that can come into contact with the first opening and closing body, comes into contact with the first opening and closing body at the contact portion when the second opening and closing body is in an open state, and keeps the first opening and closing body at an opening angle so as to be distanced from the liquid supply container that has been attached to the injection port, and as a result, the risk of a liquid leaking out while the liquid container portion is refilled with the liquid can be reduced, the leakage of the liquid being caused by the first opening and closing body coming into contact with the liquid supply container and the liquid supply container coming off from the injection port.

A liquid ejection device according to a fourth aspect of the invention includes, in the third aspect, third opening and closing bodies that are respectively provided to the plurality of injection ports and close and open the respective injection ports. The third opening and closing bodies in a state of having closed the respective injection ports are covered by the second opening and closing body in a closed state.

According to the aspect, the liquid ejection device includes the third opening and closing bodies that respectively close and open the injection ports, and the third opening and closing bodies in a state of having closed the injection ports are covered by the second opening and closing body in a closed state, and as a result, the risk of evaporation of the liquid from the liquid container portions and the occurrence of liquid leaking from the ink injection ports when the liquid ejection device is moved can be reduced.

In a liquid ejection device according to a fifth aspect of the invention, in the fourth aspect, the second opening and closing body and each third opening and closing body are configured to be pivotable until respective opening angles are reached at which they can stand on their own, and each third opening and closing body includes an abutting portion that can abut against the second opening and closing body, and as a result of the abutting portion abutting against the second opening and closing body that is in a state of being open and standing on its own, the third opening and closing body is open and stands on its own and is distanced from the liquid supply container that has been connected to the injection port.

According to the aspect, the second opening and closing body and the third opening and closing bodies are configured to be pivotable until respective opening angles are reached at which they can stand on their own, and each third opening and closing body includes an abutting portion that can abut against the second opening and closing body, and as a result of the abutting portion abutting against the second opening and closing body that is in a state of being open and standing on its own, the third opening and closing bodies are open and stand on their own and are distanced from the liquid supply container that has been connected to the injection port. As a result, the risk of a third opening and closing body pivoting in a direction of closing and coming into contact with the liquid supply container when the liquid supply container is attached to the injection port can be reduced, for example.

In a liquid ejection device according to a sixth aspect of the invention, in the fourth aspect or the fifth aspect, at least a portion of a pivoting region of the second opening and closing body and a portion of a pivoting region of the third opening and closing bodies overlap at least a portion of a pivoting region of the first opening and closing body when seen in a shaft direction of a pivoting shaft of the first opening and closing body.

According to the aspect, the second opening and closing body and the third opening and closing bodies are arranged in a space-saving manner, and functions and effects similar to those in the fifth aspect can be obtained.

In a liquid ejection device according to a seventh aspect of the invention, in any one of the second to sixth aspects, the plurality of liquid container portions are arranged in a device side portion on a device front surface side, and a first part, which covers a side surface of the plurality of liquid container portions, of a casing that constitutes an exterior of the device body protrudes sideward relative to a second part on a device rear side relative to the first part, and an opening and closing detection sensor that detects opening and closing of the second opening and closing body is arranged between the first part and the second part in a device-width direction.

According to the aspect, the opening and closing detection sensor that detects opening and closing of the second opening and closing body is arranged between the first part and the second part in the device width direction, and therefore an increase in the device width due to the arrangement of the opening and closing detection sensor can be prevented.

A liquid ejection device according to an eighth aspect of the invention includes, in the seventh aspect, a carriage unit that includes the liquid ejection unit and moves in the device-width direction. At least a portion of the opening and closing detection sensor overlaps at least a portion of the carriage unit in plan view seen in the device-width direction.

According to the aspect, an increase in size in the device depth direction caused by the installation of the opening and closing detection sensor can be suppressed.

In a liquid ejection device according to a ninth aspect of the invention, in the seventh or eighth aspect, the opening and closing detection sensor includes a detection target portion that is displaced according to the opening and closing of the second opening and closing body, and a detection portion that detects the displacement of the detection target portion, and the liquid ejection device further includes a wall between a space in which a liquid is to be ejected by the liquid ejection unit and the detection portion.

According to the aspect, as a result of providing a wall between the space in which liquid is ejected from the liquid ejection unit and the detection portion, the risk of mist that is generated when liquid is ejected from the liquid ejection unit adhering to the detection portion can be reduced. Therefore, the reduction in detection accuracy of the detection portion due to the adhesion of mist can be suppressed.

In a liquid ejection device according to a tenth aspect of the invention, in any one of the first to ninth aspects, the first opening and closing body is a scanner unit that reads a document.

Because the scanner unit is heavier than a simple cover, when the scanner unit comes into contact with the liquid supply container that has been attached to the injection port, the risk of the liquid supply container coming off or being shifted is high. According to the aspect, the risk of the heavy scanner unit coming into contact with the liquid supply container and the liquid supply container coming off or the like can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Working Example 1

First, an overview of an inkjet printer 1 (hereinafter, simply referred as printer 1), which is an example of a "liquid ejection device" according to the invention, will be described.

Figure 1:
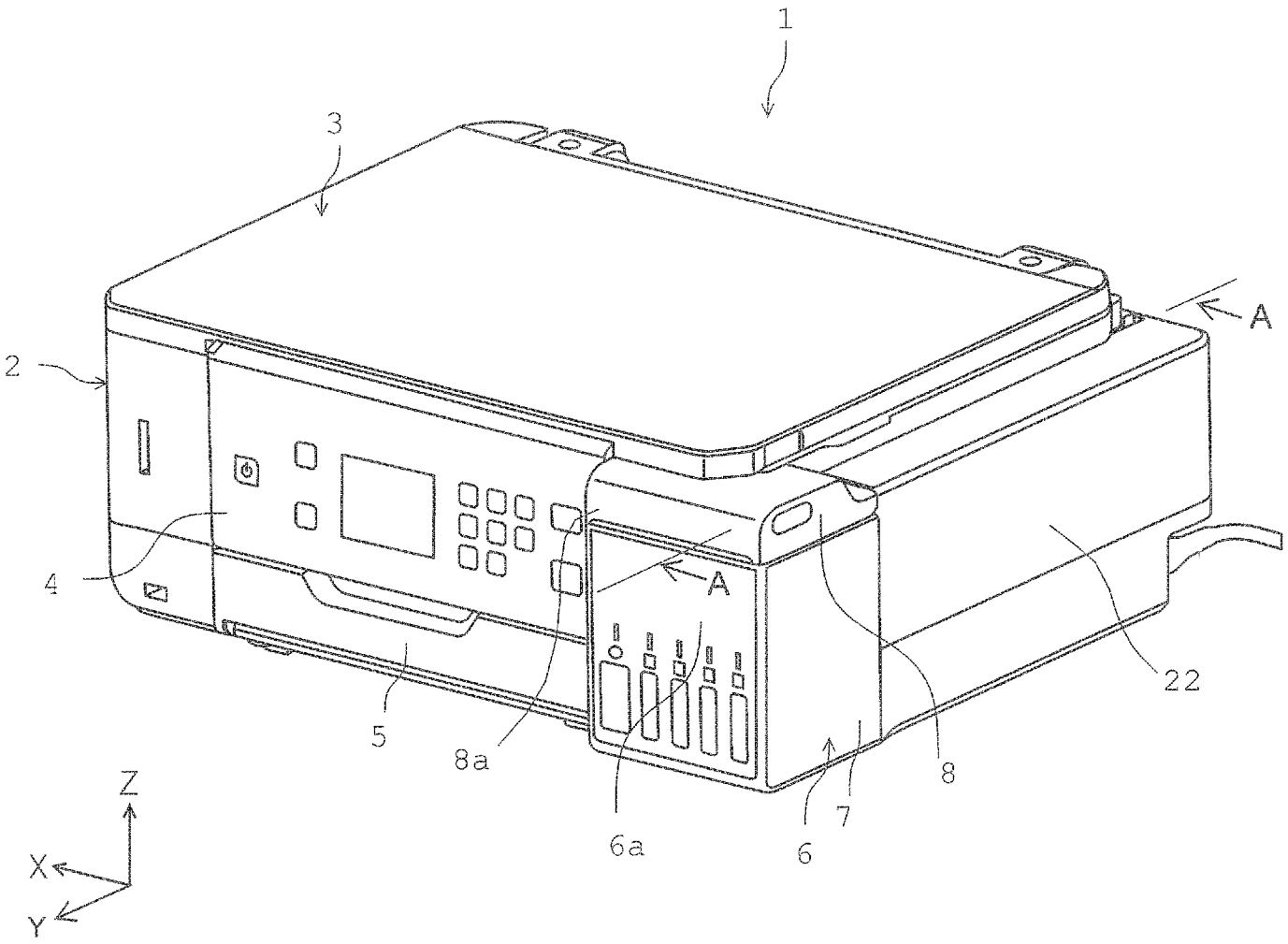
FIG. 1 is an external perspective view of a printer according to the invention.
Figure 2:
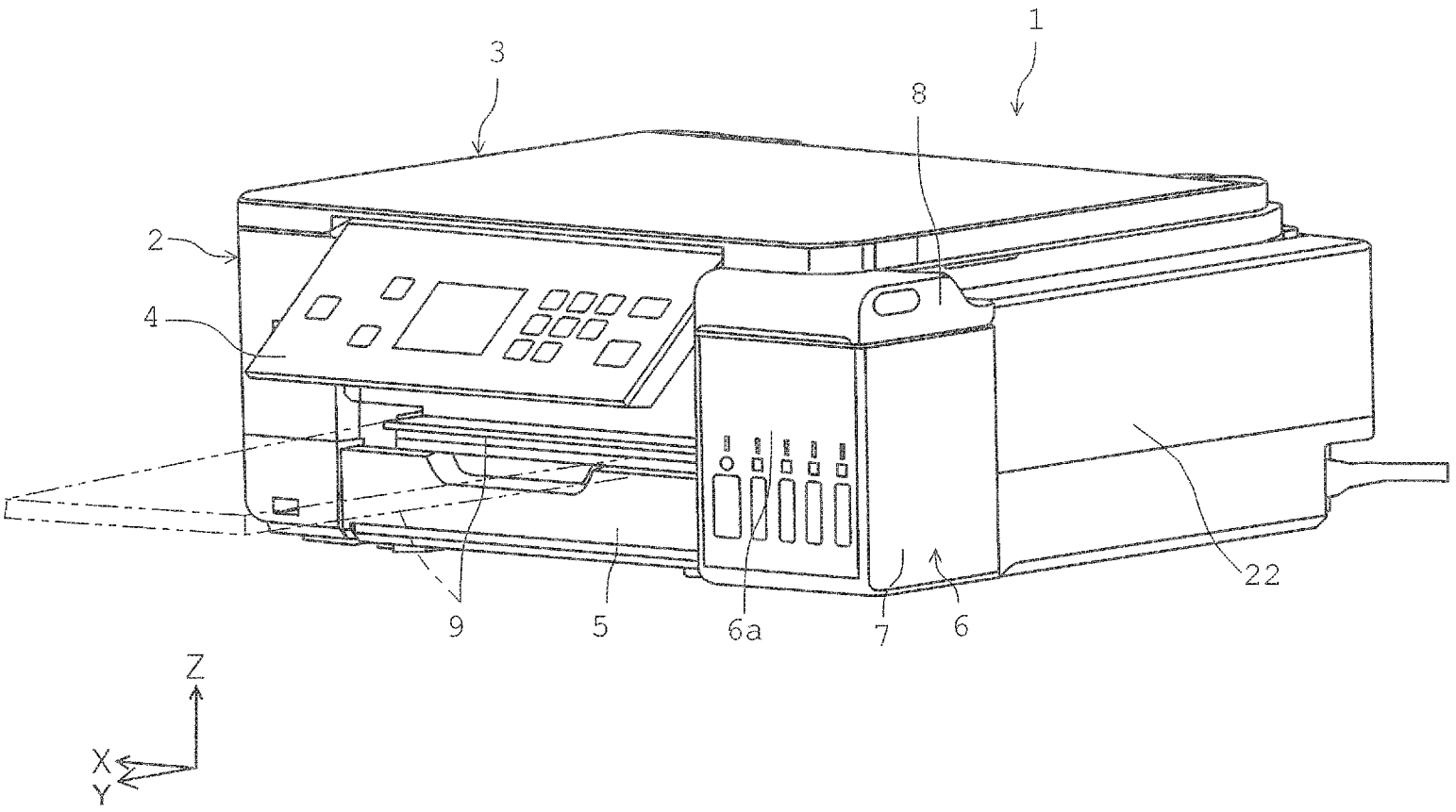
FIG. 2 is an external perspective view of the printer in a state in which an operation panel is pivoted on a device front surface side.
Figure 3:
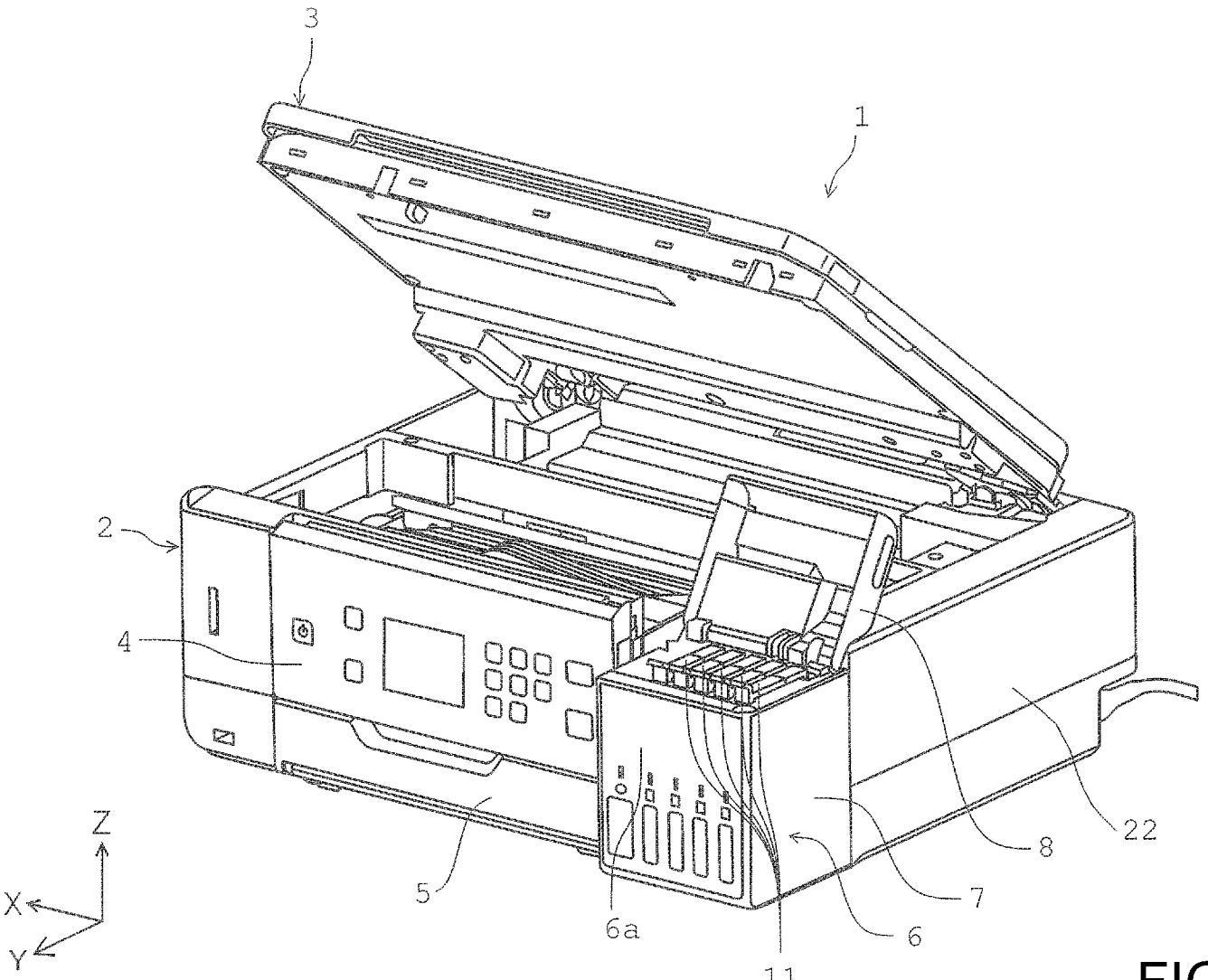
FIG. 3 is an external perspective view of the printer when a scanner and an ink tank cover are in an open state relative to a device body.
Figure 4:
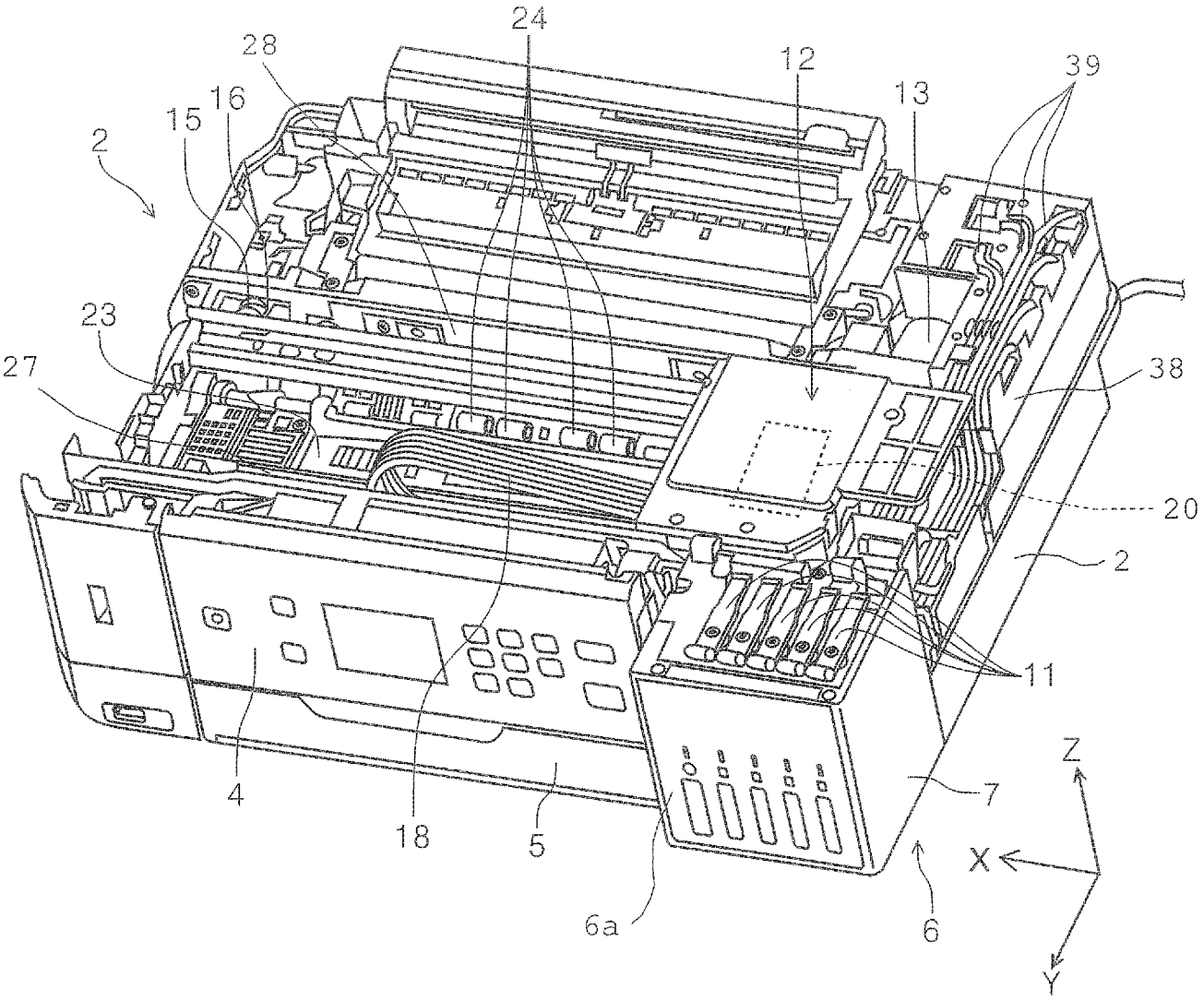
FIG. 4 is a perspective view illustrating a configuration of the device body.
Figure 5:
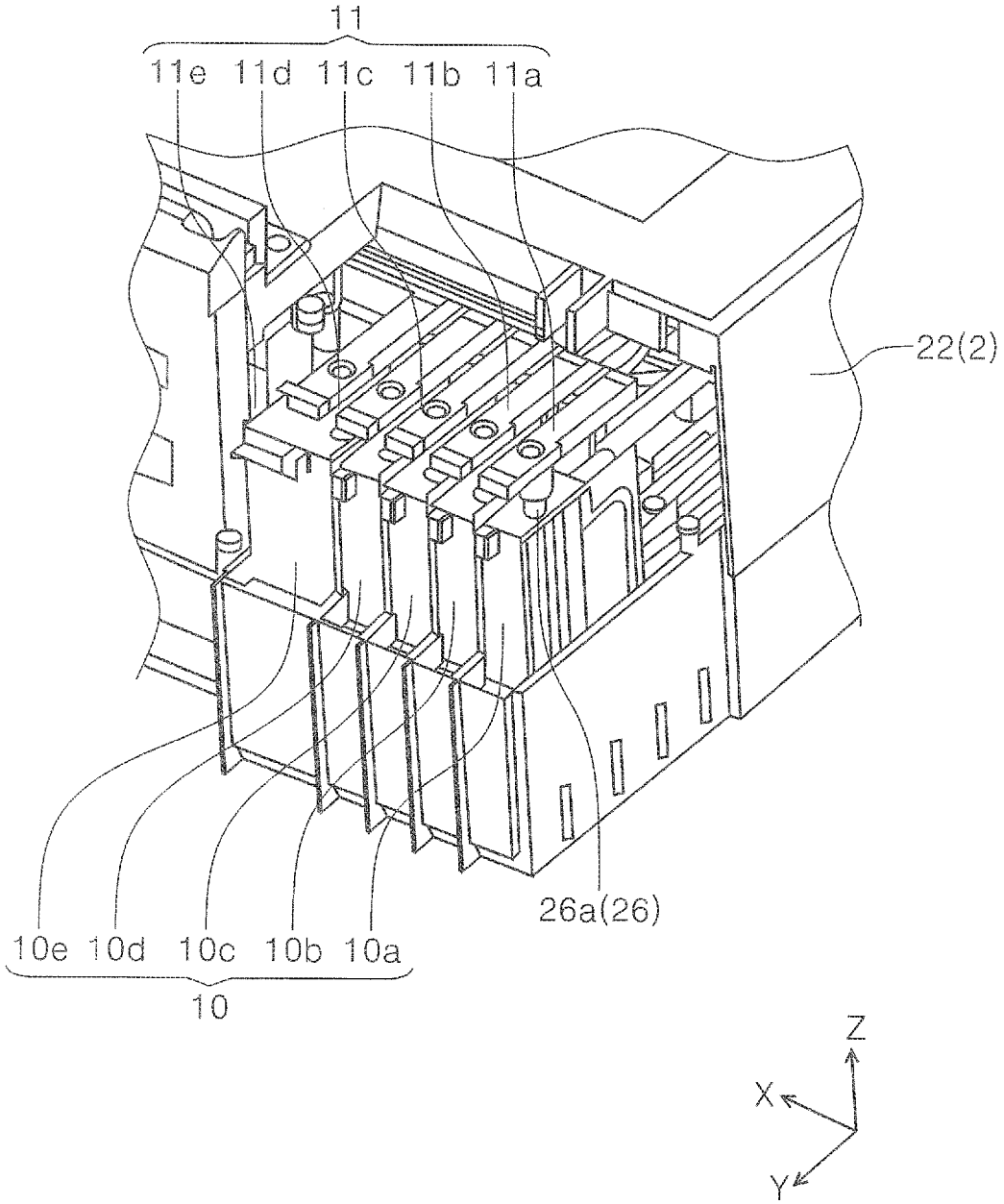
FIG. 5 is a diagram illustrating a state in which a first casing and the ink tank cover of an ink tank portion are removed from the device body.
Figure 6:
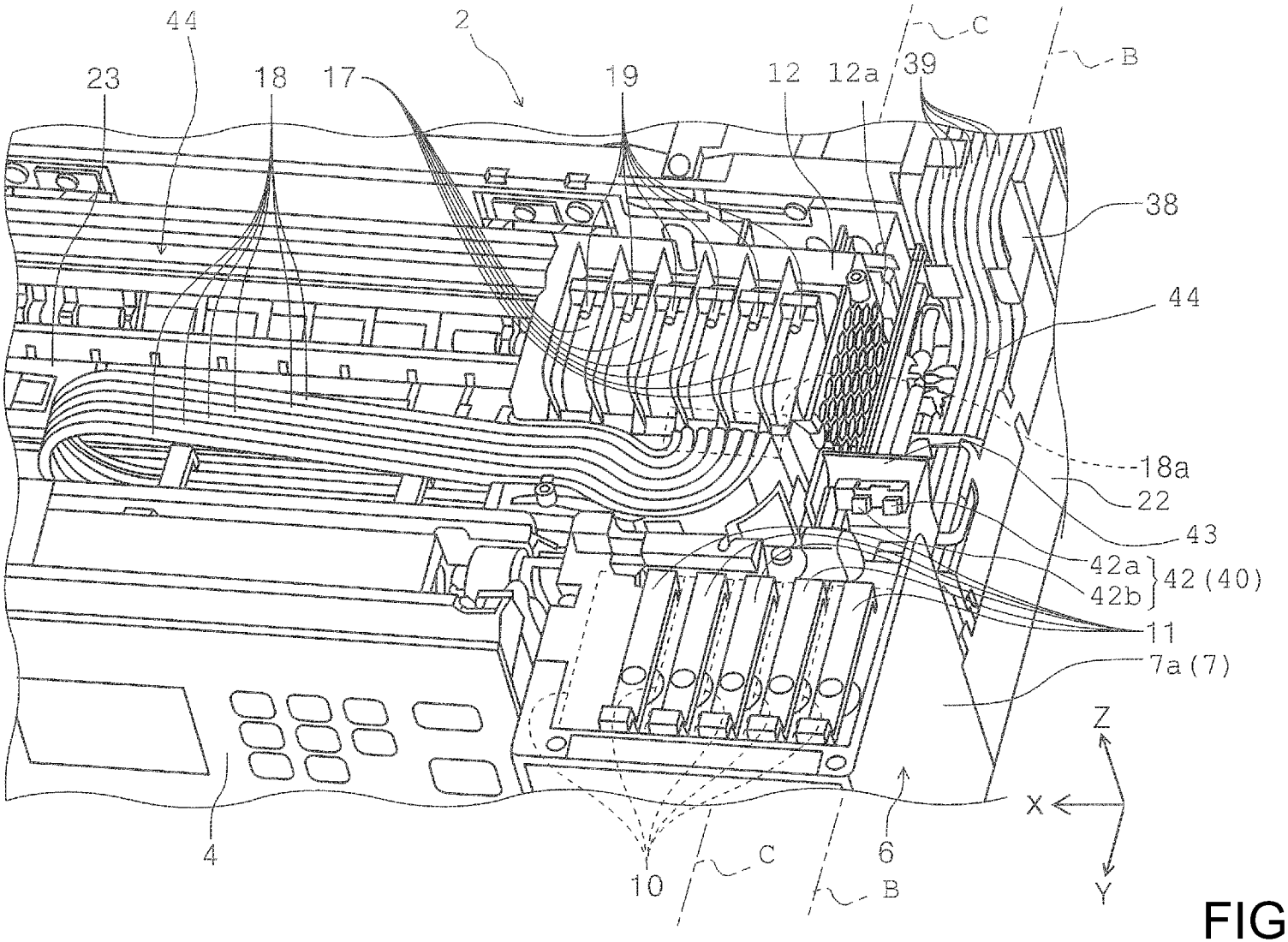
FIG. 6 is an enlarged view of the main portion inside the device body.
Figure 7:
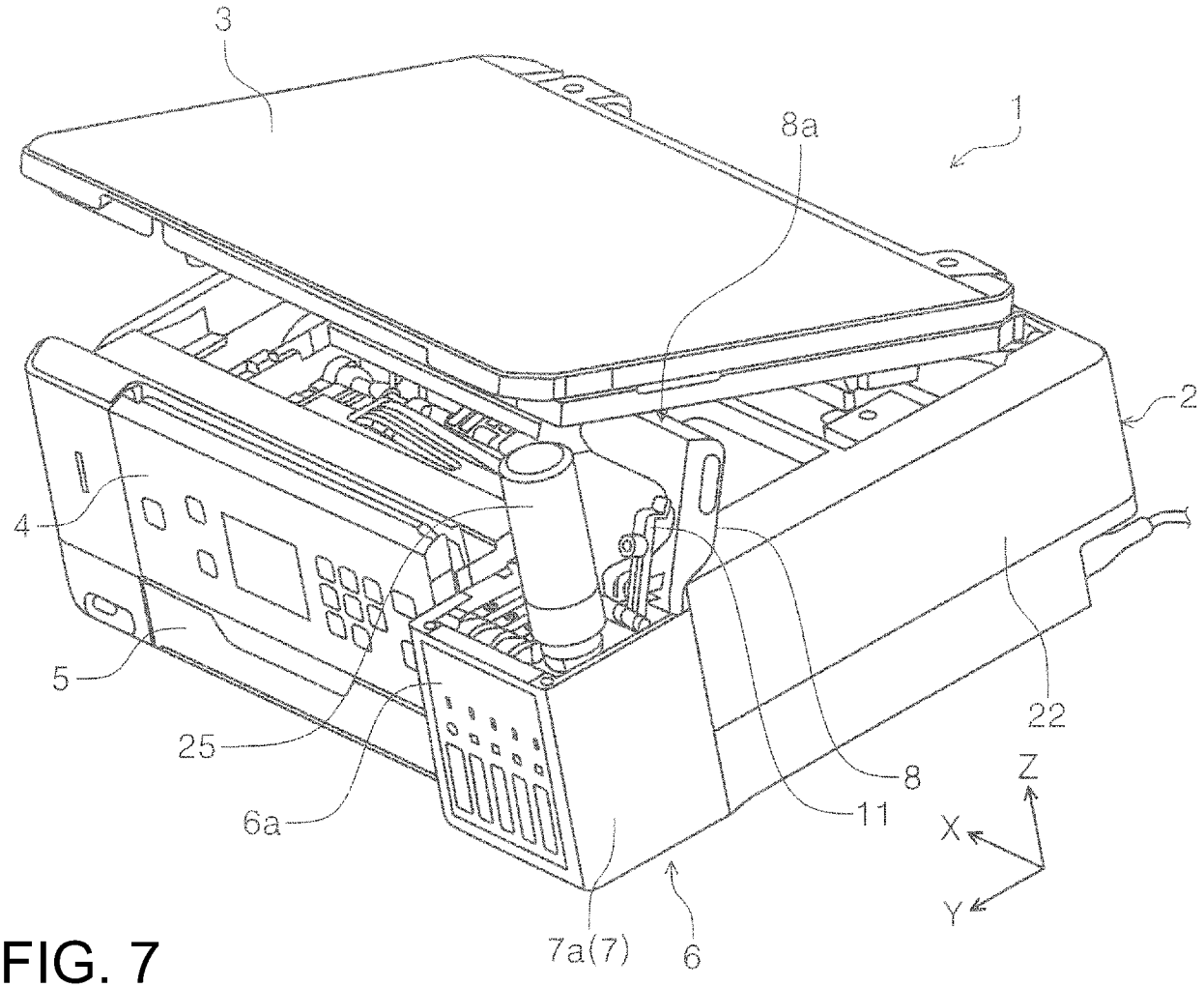
FIG. 7 is a diagram illustrating a state in which a liquid supply container is attached to an ink injection port in the printer according to the invention.
Figure 8:
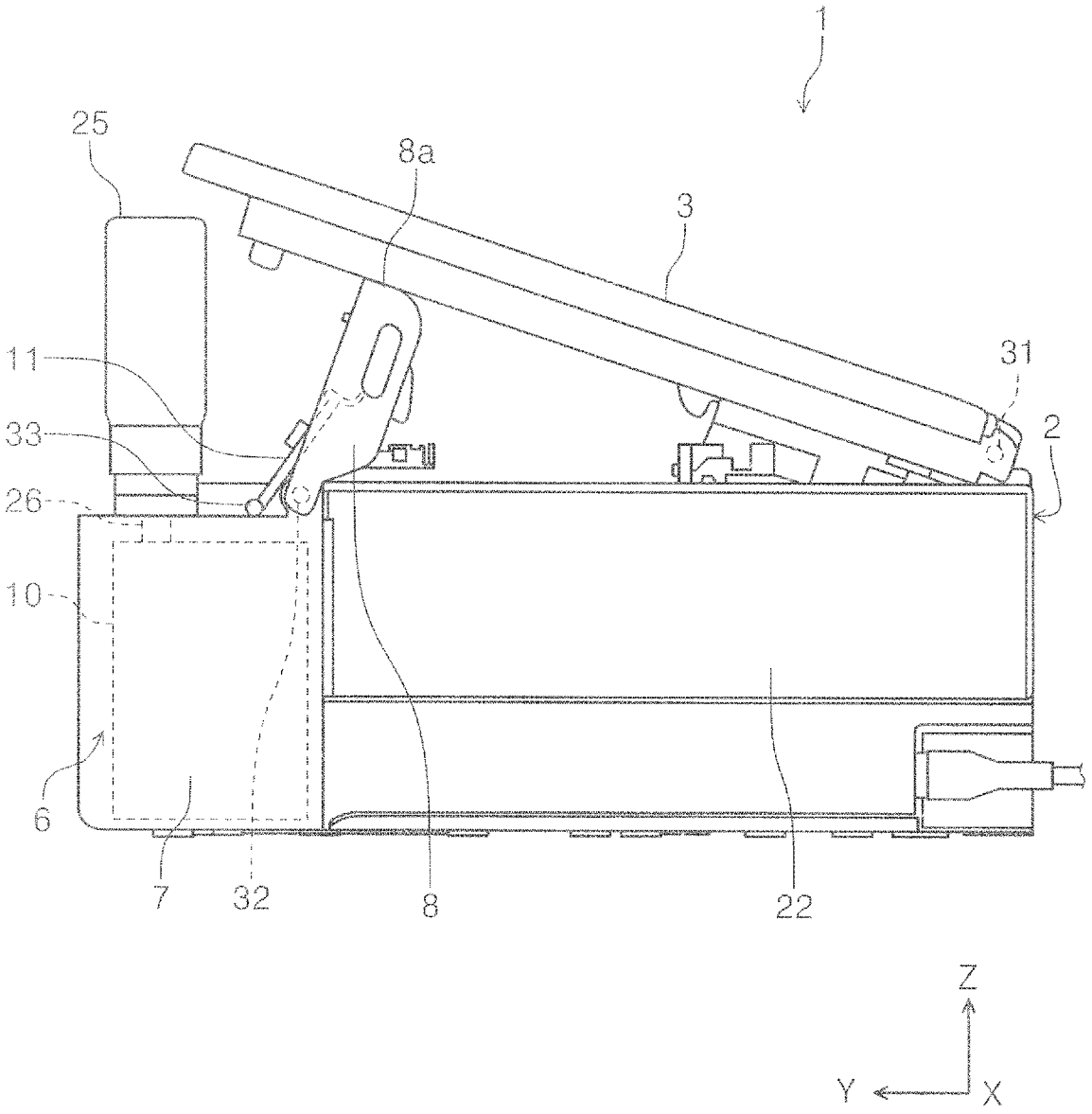
FIG. 8 is a side view of FIG. 7.
Figure 9:
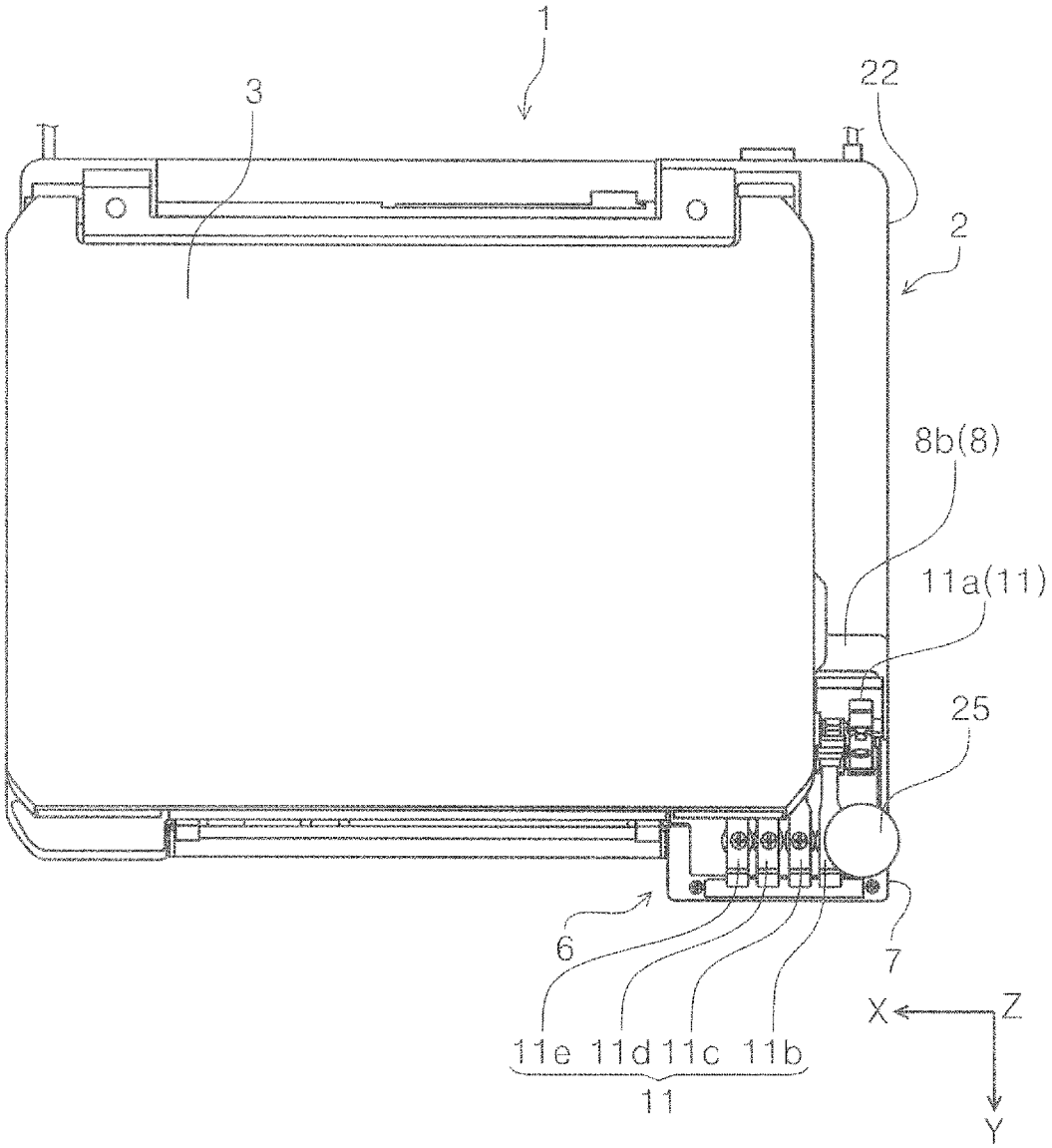
FIG. 9 is a top view of FIG. 7.

FIG. 1 is an external perspective view of a printer according to the invention. FIG. 2 is an external perspective view of the printer in a state in which an operation panel is pivoted on a device front surface side. FIG. 3 is an external perspective view of the printer when a scanner and an ink tank cover are in an open state relative to a device body. FIG. 4 is a perspective view illustrating a configuration of the device body. FIG. 5 is a diagram illustrating a state in which a first casing and the ink tank cover of an ink tank portion are removed from the device body. FIG. 6 is an enlarged view of the main portion inside the device body. FIG. 7 is a diagram illustrating a state in which a liquid supply container is attached to an ink injection port in the printer according to the invention. FIG. 8 is a side view of FIG. 7. FIG. 9 is a top view of FIG. 7.

Figure 10:
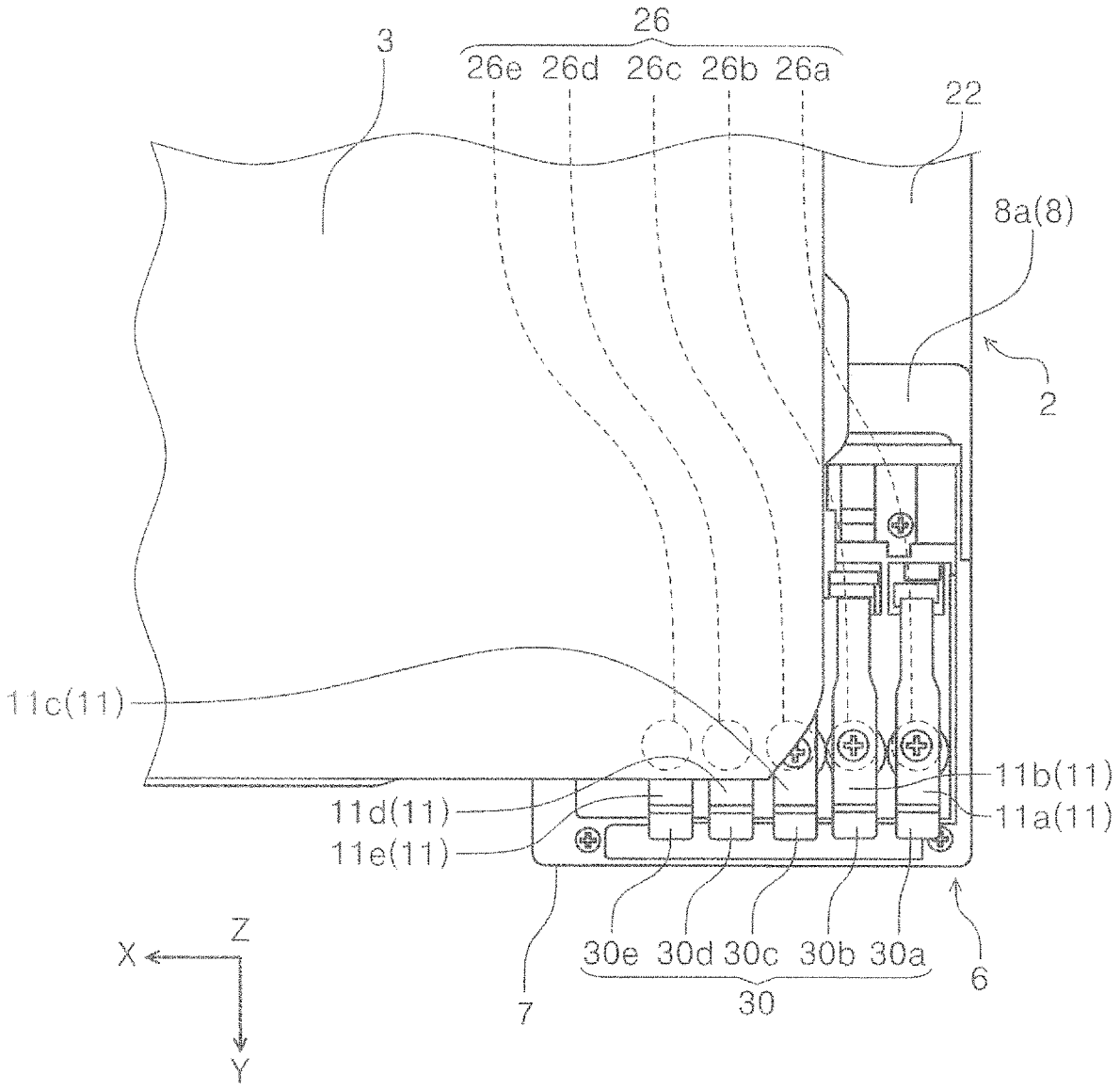
FIG. 10 is an enlarged view of the main portion in FIG. 9.
Figure 11:
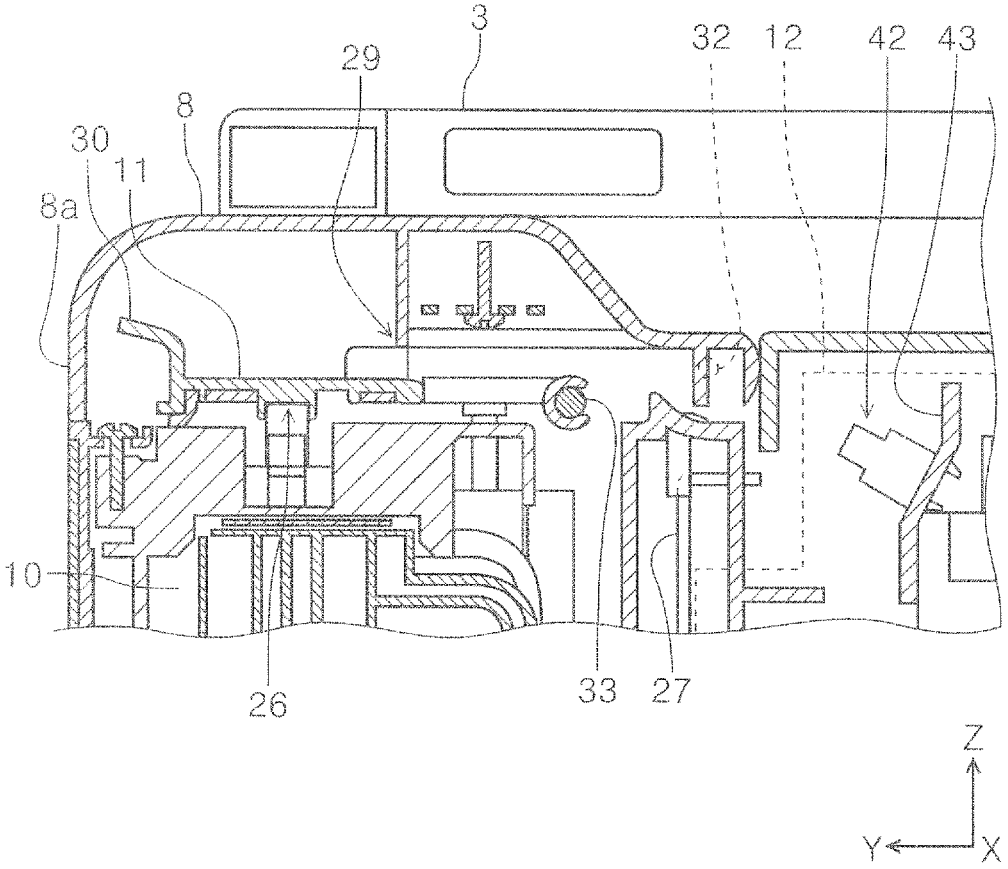
FIG. 11 is an enlarged cross-sectional view of the main portion seen in the direction of arrows A-A in FIG. 1.
Figure 12:
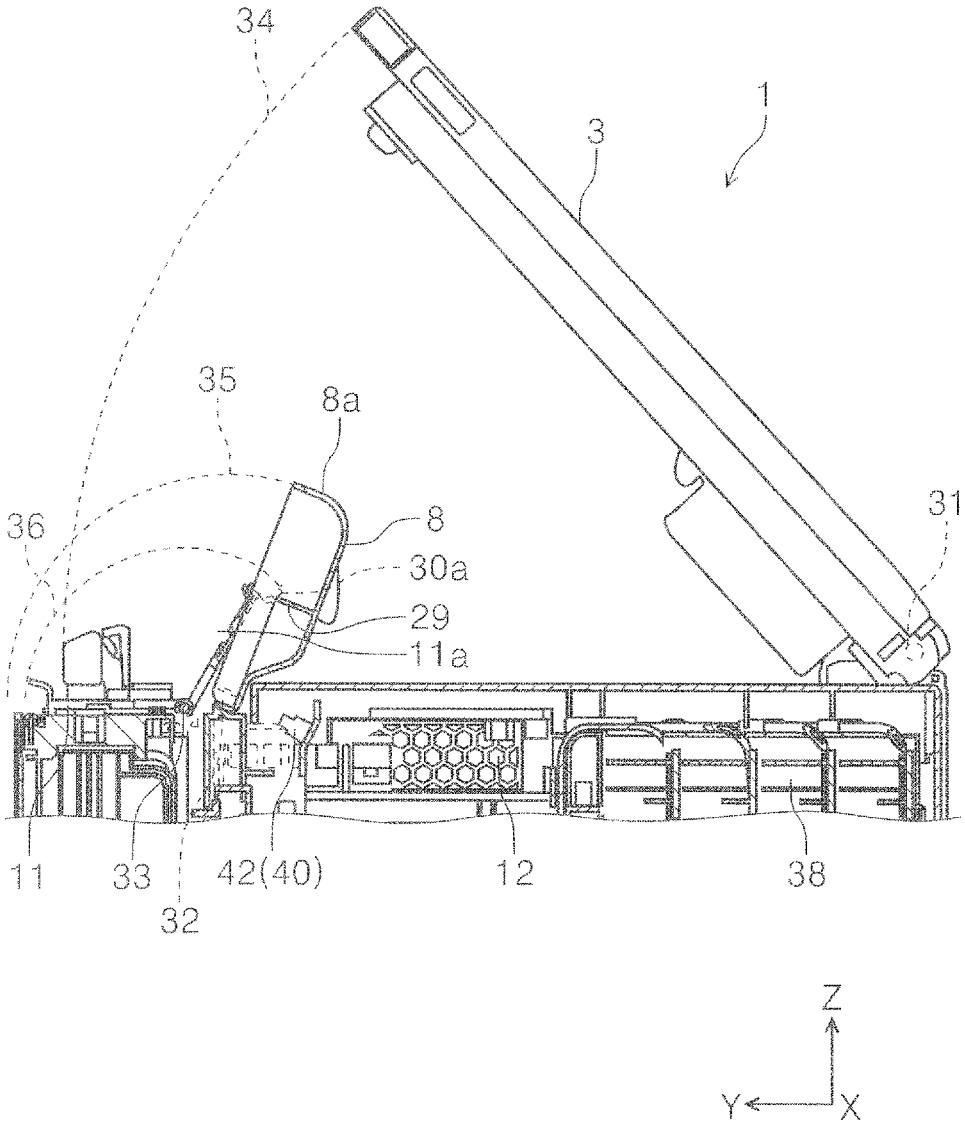
FIG. 12 is a diagram illustrating pivoting regions of a scanner unit, the ink tank cover, and an injection port cover.
Figure 13:
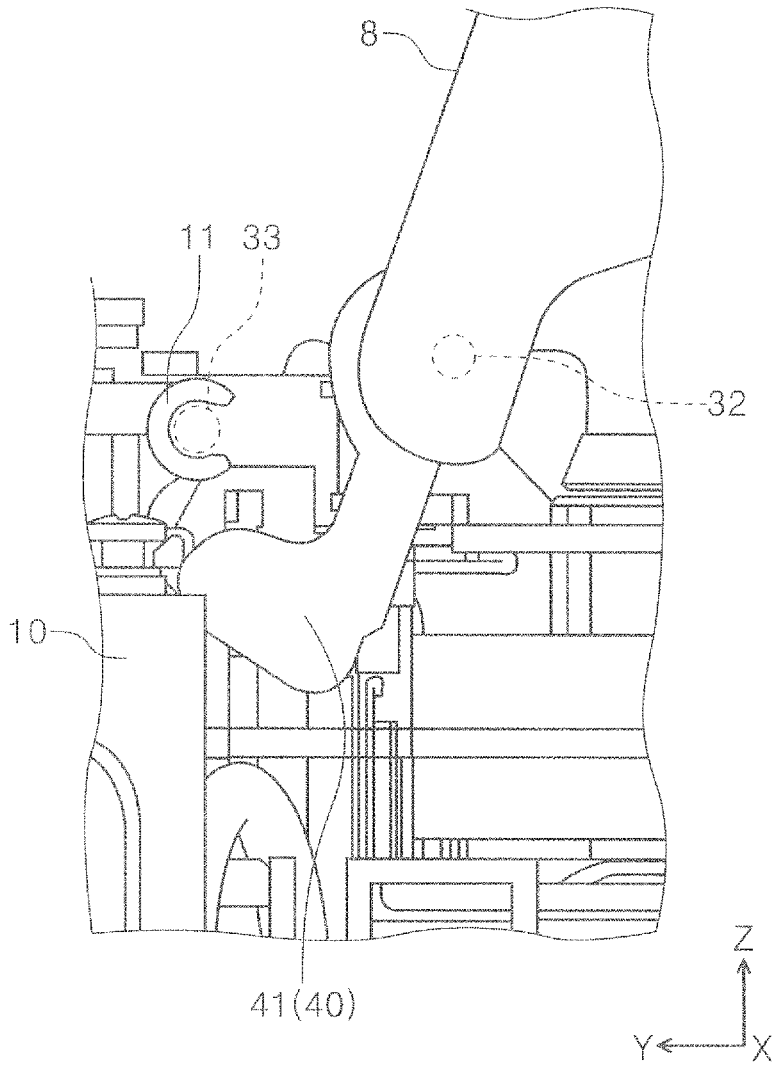
FIG. 13 is an enlarged view of the main portion of the ink tank cover.
Figure 14:
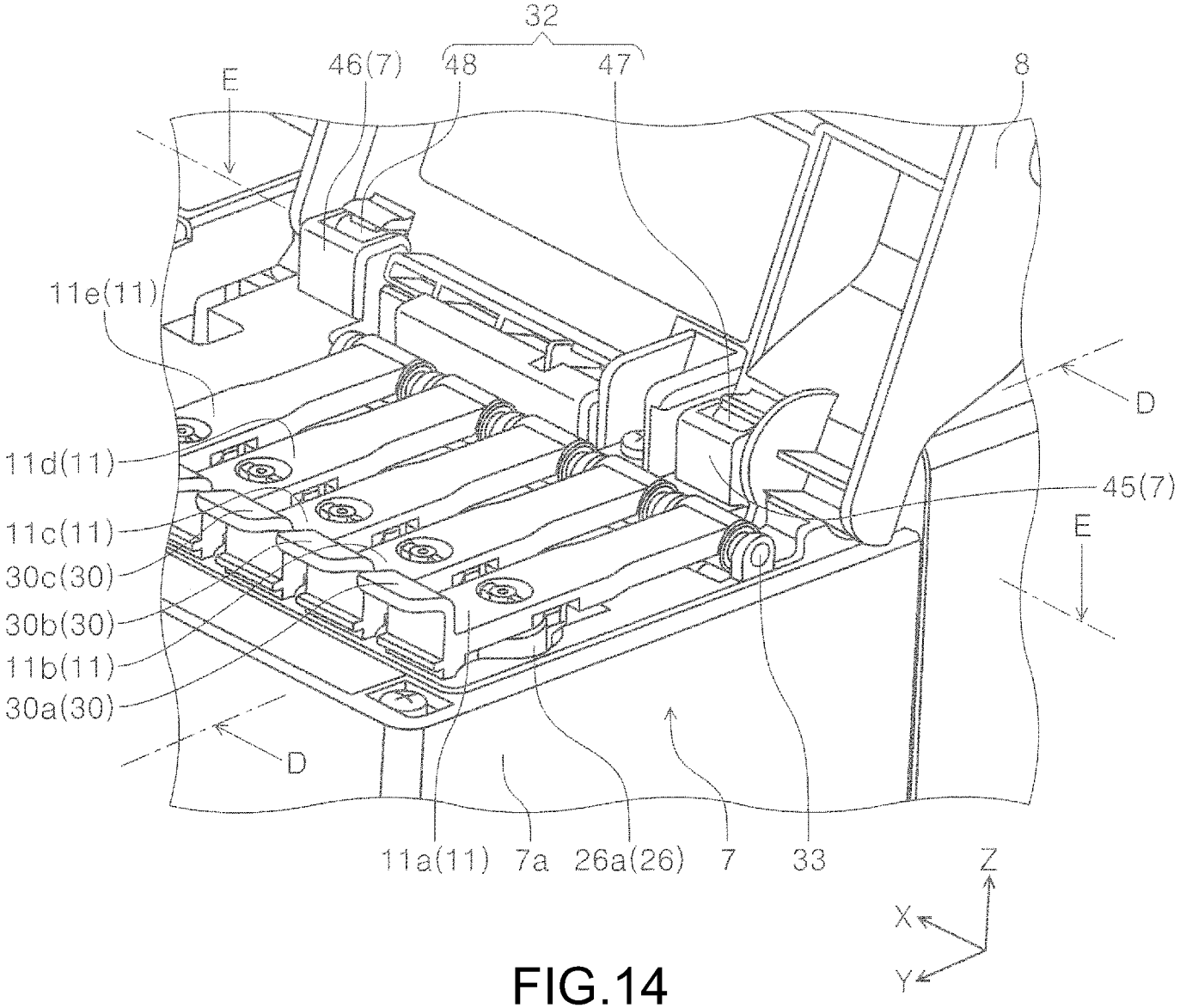
FIG. 14 is a perspective view of the ink tank portion in a state in which the ink tank cover is open.
Figure 15:
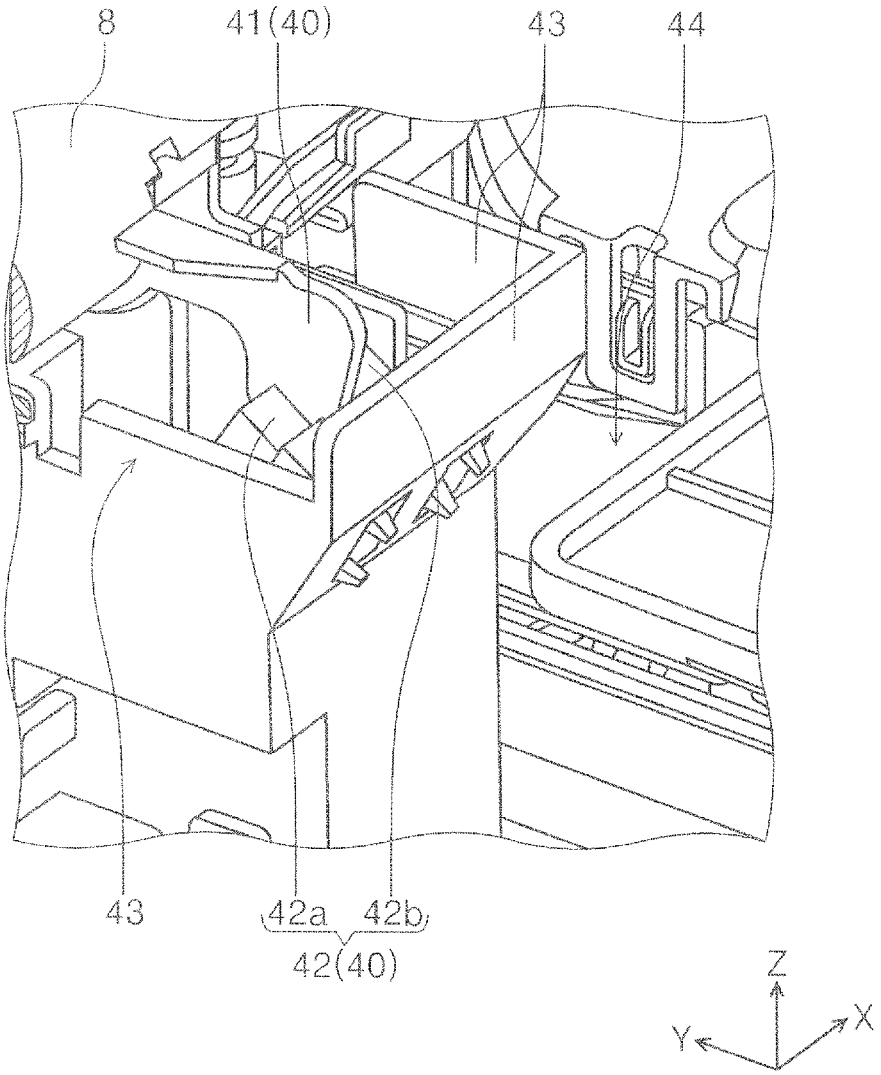
FIG. 15 is a perspective view of the vicinity of an opening and closing detection sensor of the ink tank cover seen from a back surface side.
Figure 16:
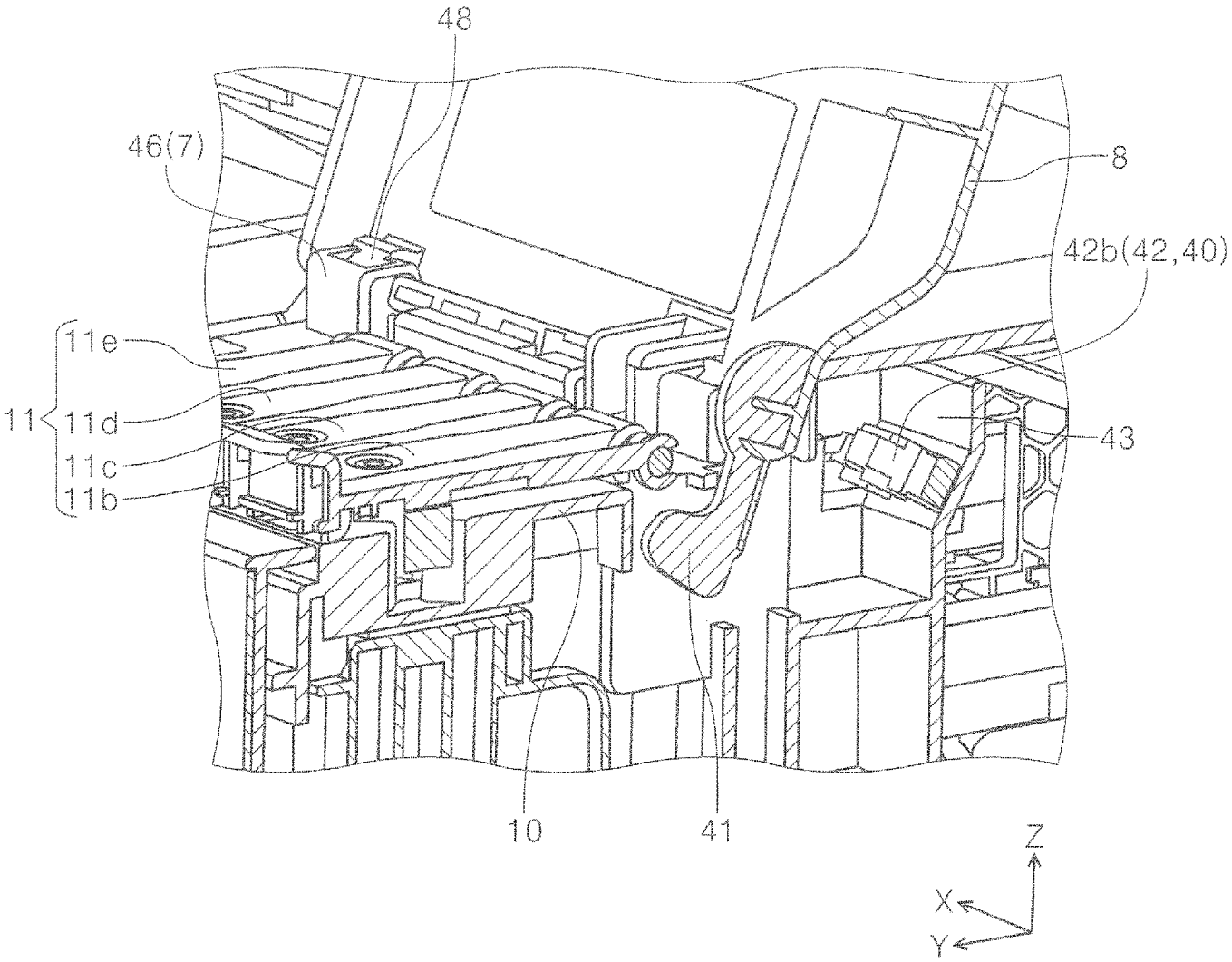
FIG. 16 is a cross-sectional view seen in the direction of arrows D-D in FIG. 14.

FIG. 10 is an enlarged view of the main portion in FIG. 9. FIG. 11 is an enlarged cross-sectional view of the main portion seen in the direction of arrows A-A in FIG. 1. FIG. 12 is a diagram illustrating pivoting regions of a scanner unit, the ink tank cover, and an injection port cover. FIG. 13 is an enlarged view of the main portion of the ink tank cover. FIG. 14 is a perspective view of the ink tank portion in a state in which the ink tank cover is open. FIG. 15 is a perspective view of the vicinity of an opening and closing detection sensor of the ink tank cover seen from a back surface side. FIG. 16 is a cross-sectional view seen in the direction of arrows D-D in FIG. 14.

Note that, in the X-Y-Z coordinate system in each diagram, an X-axis direction indicates a width direction of a recording device, and is a moving direction of a recording head, a Y-axis direction indicates a depth direction of the recording device and a medium conveyance direction, and a Z-axis direction indicates a device-height direction. In each diagram, the +X-axis direction side is the device-left side, the −X-axis direction side is the device-right side, the +Y-axis direction is the device front surface side, the −Y-axis direction side is the device-back surface side, the +Z-axis direction side is the device-upper side, and the −Z-axis direction side is the device-lower side.

Overall Configuration of Printer

Hereinafter, an overall configuration of the printer 1 will be described. The printer 1 (FIG. 1) includes a device body 2 including a recording head 20 (FIG. 4) serving as a "liquid ejection unit" that ejects a liquid and a scanner unit 3, serving as a "first opening and closing body" that opens and closes at least a portion of an upper portion of the device body 2, that reads a document.

The reference sign 4 on a device front surface side of the printer 1 in FIG. 1 indicates an operation panel 4 constituted by a power button, operation buttons for various print settings and execution of recording, a display unit that displays print setting content and displays a preview of a print image, and the like. Also, the operation panel 4 is attached to the device body 2 so as to be able to pivot on the device front surface side, as shown in FIG. 2.

Also, as shown in FIG. 2, when the operation panel 4 is pivoted, a medium discharge tray 9 that is stored in the device body 2 can move forward. The medium discharge tray 9 is configured to be movable back and forth between a position of being stored in the device body 2 (refer to a portion shown by solid lines in FIG. 2) and a position of being drawn out to the device front surface side from the device body 2 (refer to a portion shown by two-dot chain lines in FIG. 2).

Also, a medium container portion 5 that can contain a medium is mounted to the device body 2 on a device-lower side of the medium discharge tray 9 in the device body 2 such that the medium container portion 5 can be inserted and extracted from the device front surface side.

Also, a scanner unit 3 that is provided in an upper portion of the device body 2 includes a pivoting shaft 31 (refer to FIGS. 8 and 12) on a device-back surface side, as shown in FIG. 3, so as to be pivotable relative to the device body 2, and can be switched between a posture (refer to FIGS. 1 and 2) of being closed and a posture (refer to FIG. 3) of being opened relative to the device body 2.

Also, an ink tank portion 6 is provided in a device-right end portion of the device body 2 on the device front surface side in FIGS. 1 to 4. The ink tank portion 6 includes a plurality of ink tanks 10 (FIG. 5) each serving as a "liquid container portion" that contain ink of each color serving as a "liquid" that is to be supplied to a later-described recording head 20, a first casing 7 that surrounds the plurality of ink tanks 10, and an ink tank cover 8 serving as a "second opening and closing body" that is pivotably attached to the first casing 7. The device body 2 is constituted by the first casing 7 that constitutes the ink tank portion 6 and a second casing 22 that mainly accommodates a recording mechanical unit that includes a carriage unit 12 including the recording head 20. The ink tank portion 6 is provided separately from the carriage unit 12. The ink tank portion 6 will be further described later.

Next, in FIG. 4, the carriage unit 12 that includes the recording head 20 serving as a "liquid ejection head" is arranged on a back surface side (−Y-axis direction) of the ink tank portion 6. The recording head 20 is provided in a lower portion of the carriage unit 12. The carriage unit 12 is configured to reciprocally move in a device width direction (X-axis direction), which is a scanning direction, in the device body 2, for example. More specifically, the drive mechanism of the carriage unit 12 is provided with a drive motor 13 on a back surface side (−Y-axis direction) of the carriage unit 12 in a device-depth direction.

The drive shaft of the drive motor 13 is provided with a driving pulley (that is unseen in FIG. 4, but is provided on a device front surface side of the drive motor 13). Also, inside the device body 2 shown in FIG. 4, a driven pulley 15 is provided at a position distanced from the unshown driving pulley in the device width direction. The driven pulley 15 is provided to be driven to rotate in accordance with the rotation of the driving pulley. An endless belt 16 is wound around the driving pulley and the driven pulley 15. Also, at least a portion of the endless belt 16 is attached to the carriage unit 12 on the back surface side of the carriage unit 12.

When the drive motor 13 rotates, the endless belt 16 is driven to rotate, and the carriage unit 12 attached to the endless belt 16 moves in the X-axis direction. Note that the position of the carriage unit 12 shown in FIG. 4 is set as the home position of the carriage unit 12 inside the device body 2, for example.

Note that, in FIG. 4, a first frame 27 and a second frame 28 that extend in the X-axis direction are respectively provided on the front surface side and back surface side of the carriage unit 12. The carriage unit 12 moves while being guided by the first frame 27 and the second frame 28.

Also, a plurality of relay adapters 17 that relay the supply of ink that is supplied to the recording head 20 from the ink tanks 10 are mounted inside the carriage unit 12 shown in FIG. 6. The relay adapters 17 are configured to supply ink to nozzles (unshown) provided in the recording head 20.

Also, the relay adapters 17 are connected to the ink tanks 10 via respective ink supply tubes 18 that supply ink supplied from the ink tanks 10 to the relay adapters 17.

The reference signs 19 in FIG. 6 are connection portions 19 of the ink supply tubes 18 in the respective relay adapters 17. Note that, in FIG. 6, the depiction of the ink supply tubes 18 from a portion that is shown by reference sign 18*a* and is surrounded by dotted lines in FIG. 6 to the connection portions 19 is omitted in order to clearly show the connection portions 19. In actuality, one end of each of the ink supply tubes 18 are respectively connected to the connection portions 19.

Next, in FIG. 4, a medium support member 23 that extends in the device width direction is provided under the recording head 20. Also, conveyance roller pairs 24 are provided on a back surface side of the medium support member 23.

Here, the recording operation performed on a medium by the printer 1 will be described mainly with reference to FIG. 4. A medium accommodated in the medium container portion 5 is fed to the conveyance roller pairs 24 by an unshown feeding means. The conveyance roller pairs 24 nip the medium and send the medium to a region that opposes the recording head 20 under the recording head 20. Then, the medium supported by the medium support member 23 receives ink ejected from the nozzles (unshown) of the recording head 20 onto a surface thereof that opposes the recording head 20. Accordingly, recording is performed on the surface of the medium that opposes the recording head 20. Then, the medium on which recording is performed is discharged to the medium discharge tray 9 (FIG. 2) that projects on the device front surface side of the device body 2.

Ink Tank Portion

Next, a detailed configuration of the ink tank portion 6 will be described.

The ink tanks 10 are each configured such that ink can be injected from a liquid supply container 25 (FIG. 7). When the ink tank cover 8 (second opening and closing body) is opened as shown in FIG. 3, injection port covers 11 (referred also to FIG. 14) each serving as a "third opening and closing body" are exposed. Injection port covers 11*a*, 11*b*, 11*c*, 11*d*, and 11*e* (FIG. 14) are covers that respectively cover ink injection ports 26*a*, 26*b*, 26*c*, 26*d*, and 26*e* (FIG. 10) respectively provided in ink tanks 10*a*, 10*b*, 10*c*, 10*d*, 10*e* (FIG. 5) of respective colors, and are respectively attached to ink injection ports 26*a*, 26*b*, 26*c*, 26*d*, and 26*e*. Each injection port cover 11 includes a pivoting shaft 33 (FIGS. 8 and 12) on a back surface side (−Y-axis direction) of the ink tank 10 so as to be pivotably attached to the ink tank 10.

In other words, the injection port covers 11 that open and close the respective ink injection ports 26 are configured to be covered by the closed-state ink tank cover 8 in a state of having closed the ink injection ports 26. When an injection port cover 11 is open, a liquid supply container 25 can be attached to the ink injection port 26 (ink injection port 26*a*) so as to refill ink, as shown in FIGS. 7 to 9.

The ink injection port 26 can be opened and closed by the injection port cover 11, and the injection port cover 11 in a state of having covered the ink injection port 26 is covered by the closed-state ink tank cover 8, and as a result, the risk of ink evaporating from the ink tank 10 and occurrence of liquid leaking from the ink injection port 26 when the printer 1 is moved can be reduced.

In the present working example, five ink tanks 10 are provided, as shown in FIG. 5, and the ink tanks 10 respectively contain black ink, magenta ink, yellow ink, cyan ink, and photo black ink, for example. Also, a display unit 6*a* (FIG. 1) with which the remaining ink amount in each ink tank 10 can be confirmed is provided on a device-front surface side of the ink tank portion 6.

Also, each ink tank 10 is connected to a buffer tank 38 (FIG. 6) provided on the device-back surface side by a connection tube 39.

When the temperature in the vicinity of the printer 1 increases, for example, if the injection port cover 11 is in a state of having covered the ink injection port (unshown), the pressure inside the ink tank 10 increases, and as a result, the ink contained in the ink tank 10 may be pushed out to the inside of the buffer tank 38.

The amount of ink that each buffer tank 38 can contain is set to be approximately the same as the amount that an ink tank 10 to which the buffer tank 38 is connected by the connection tube 39 can contain or more, for example. Therefore, even if the ink contained in an ink tank 10 flows into the buffer tank 38, it is possible to prevent or suppress ink leaking out from a buffer tank 38.

Arrangement of Ink Tanks

The ink tank portion 6 is arranged so as to be located under the scanner unit 3 in a posture of being closed such that at least a portion of the ink tank portion 6 in the device width direction (X-axis direction) is closed, as shown in FIG. 1.

When the scanner unit 3 takes a posture such that the scanner unit 3 is open relative to the device body 2, the ink tank cover 8 is completely exposed, and the ink tank cover 8 can be opened as shown in FIG. 3. The ink tank cover 8 has a pivoting shaft 32 (FIG. 8) on a back surface side (−Y-axis direction) of the first casing 7, and is pivotably attached to the first casing 7 so as to close and open an upper portion of the later-described ink injection ports 26 (FIGS. 5 and 8).

Here, at least one of the plurality of ink injection ports 26*a*, 26*b*, 26*c*, 26*d*, and 26*e* of the ink tanks 10 (ink injection ports 26*c*, 26*d*, and 26*e* shown in FIG. 10 in the present working example) is located inside an opening and closing region that is opened and closed by the scanner unit 3 (first opening and closing body), that is, a region in an upper portion of the device body 2 that is covered by the scanner unit 3, as shown in FIG. 10. The other ink injection ports 26*a* and 26*b* are located outside the opening and closing region. Note that when a portion of the injection port is in the opening and closing region, as in the case of the ink injection port 26*c* in FIG. 10, the injection port is regarded as being located inside the opening and closing region.

As a result of arranging the plurality of ink injection ports 26*a*, 26*b*, 26*c*, 26*d*, and 26*e* in this way, the following functions and effects can be obtained. That is, some ink injection ports 26*c*, 26*d*, and 26*e* are located in the opening and closing region that is opened and closed by the scanner unit 3, and as a result, the ink tanks 10 can be provided in a space-saving manner. Also, since the other ink injection ports 26*a* and 26*b* are located outside the opening and closing region, in FIG. 10, even if the scanner unit 3 is unintentionally closed while a liquid supply container 25 is attached to the ink injection port 26*a* or the ink injection port 26*b* that is located outside the opening and closing region so as to refill an ink tank 10 with ink, the risk of the scanner unit 3 coming into direct contact with the liquid supply container 25, the liquid supply container 25 coming off the ink injection port 26, and the ink leaking out can be suppressed to a low level. Therefore, the ink tank 10 can be stably refilled with ink.

Note that it is preferable that the ink injection port 26 of the ink tank 10 of an ink color that is frequently refilled, the ink tank 10 of black ink for example, is located outside the opening and closing region. Accordingly, when the ink tank 10 is refilled with ink, the risk of the scanner unit 3 coming into contact with the liquid supply container 25 as a result of the scanner unit 3 being closed can be effectively reduced.

Specifically, because the scanner unit 3 (refer to FIGS. 7 to 9) serving as a "first opening and closing body" in the present working example is relatively heavy, when the scanner unit 3 comes into contact with the liquid supply container 25 that has been attached to the ink injection port 26, the risk of the liquid supply container 25 coming off or being shifted is high. As a result of arranging the ink injection ports 26 in this way, the risk of the heavy scanner unit 3 coming into contact with the liquid supply container 25 and the liquid supply container 25 coming off or the like can be reduced.

Note that the "first opening and closing body" is not limited to the scanner unit 3, and may be a cover that simply covers the upper portion of the device body 2, for example.

Relation Between Ink Tank Cover and Scanner Unit

Also, the ink tank cover 8 (second opening and closing body) of the present working example has the role of a stopper that restricts the opening angle of the scanner unit 3 (first opening and closing body) at a predetermined angle.

Specifically, the ink tank cover 8 includes a contact portion 8*a* (FIGS. 7 and 8) that can come into contact with the scanner unit 3, and when the ink tank cover 8 is in an open state, as shown in FIGS. 7 and 8, the contact portion 8*a* comes into contact with the scanner unit 3, and the ink tank cover 8 holds the scanner unit 3 at an opening angle so as to be distanced from the liquid supply container 25 that has been attached to the ink injection port 26. In other words, the ink tank cover 8 holds the scanner unit 3 at an opening angle so as to not come into contact with the liquid supply container 25 that has been attached to the ink injection port 26.

As a result of the ink tank cover 8 in the open state working as a stopper of the scanner unit 3 in this way, the risk of the scanner unit 3 coming into contact with the liquid supply container 25 while the ink tank 10 is being refilled with ink can be more securely avoided. Therefore, the risk of the scanner unit 3 coming into contact with the liquid supply container 25 while the ink tank 10 is being refilled with ink, the liquid supply container 25 coming off from the ink injection port 26, and the ink leaking out can be further reduced.

Relation Between Ink Tank Cover and Injection Port Cover

The ink tank cover 8 and the injection port cover 11 are configured to pivot until opening angles are reached at which they can stand on their own, as shown in FIG. 8. The ink tank cover 8 (FIG. 8) is configured to come into contact with the second casing 22 on the back surface side so as to be open and stand on its own.

Also, as shown in FIG. 10, abutting portions 30*a* to 30*e* (collectively referred to as abutting portion 30 when it is unnecessary to distinguish them) that can abut against the abutted portion 29 (FIG. 12) of the ink tank cover 8 are respectively provided to the injection port covers 11*a* to 11*e*. The injection port cover 11 (injection port cover 11*a* in FIG. 12) is configured to be open and stand on its own as a result of the abutting portion 30 abutting against the abutted portion 29 of the ink tank cover 8 that is open and stands on its own as shown in FIG. 12, and is distanced from the liquid supply container 25 that has been connected to the ink injection port 26.

Accordingly, when the liquid supply container 25 is attached to the ink injection port 26, the risk of the injection port cover 11 pivoting in the closing direction and coming into contact with the liquid supply container 25 can be reduced, for example.

Note that the opening angles at which the ink tank cover 8 and the injection port cover 11 can stand on their own are an opening angle that is approximately larger than 90°, although this depends on the center of gravity of the covers. Also, the injection port cover 11 may be configured to stand on its own without abutting against the ink tank cover 8.

Also, in FIG. 12 that is a diagram seen in the shaft direction of a pivoting shaft of the scanner unit 3, at least portions of a second pivoting region 35, which is a pivoting region of the ink tank cover 8, and a third pivoting region 36, which is a pivoting region of the injection port cover 11, overlap with at least a portion of a first pivoting region 34, which is a pivoting region of the scanner unit 3.

According to this configuration, the ink tank cover 8 and the injection port cover 11 can be arranged in a space-saving manner.

Note that the pivoting shaft 32 of the ink tank cover 8 in FIG. 11 is provided rearward in the device depth direction, that is, in the −Y-axis direction, relative to the first frame 27 (refer also to FIG. 4) provided on a device-front surface side of the carriage unit 12. Also the pivoting shaft 32 of the ink tank cover 8 in FIG. 11 is provided upward in a height direction, that is, in the +Z-axis direction, relative to the ink injection port 26.

Opening and Closing Detection Sensor of Ink Tank Cover

The ink tank portion 6 includes an opening and closing detection sensor 40 (FIG. 15) that detects an open or closed state of the ink tank cover 8.

Here, the ink tank portion 6 that accommodates the plurality of ink tanks 10 is arranged in a device side portion in the −X-axis direction on the device front surface side in the device body 2, as shown in FIG. 6 (refer also to FIG. 1).

Also, with reference to FIG. 6, a side surface 7*a*, serving as a "first part", in the −X-axis direction in the first casing 7 that covers the plurality of ink tanks 10 and is a casing that constitutes the exterior of the device body 2 protrudes in the −X-axis direction relative to a unit side surface 12*a*, serving as a "second part", in the −X-axis direction of the carriage unit 12 that is located on the device rear side relative to the side surface 7*a*. The opening and closing detection sensor 40 that detects opening and closing of the ink tank cover 8 is arranged between the side surface 7*a* and the unit side surface 12*a* in the device width direction (X-axis direction). Note that, in FIG. 6, the reference sign B and the reference sign C respectively indicate the position of the side surface 7*a* serving as the "first part" in the X-axis direction and the position of the unit side surface 12*a* serving as the "second part". The opening and closing detection sensor 40 is arranged between the position B and the position C in the X-axis direction, which is the device-width direction. Also, in FIG. 6, a detection portion 42 that constitutes the opening and closing detection sensor 40 is shown. A specific configuration of the opening and closing detection sensor 40 will be described later.

As a result of the opening and closing detection sensor 40 that detects opening and closing of the ink tank cover 8 being arranged between the side surface 7*a* and the unit side surface 12*a* in the device-width direction, the width of the device can be prevented from increasing due to the arrangement of the opening and closing detection sensor 40.

Figure 17:
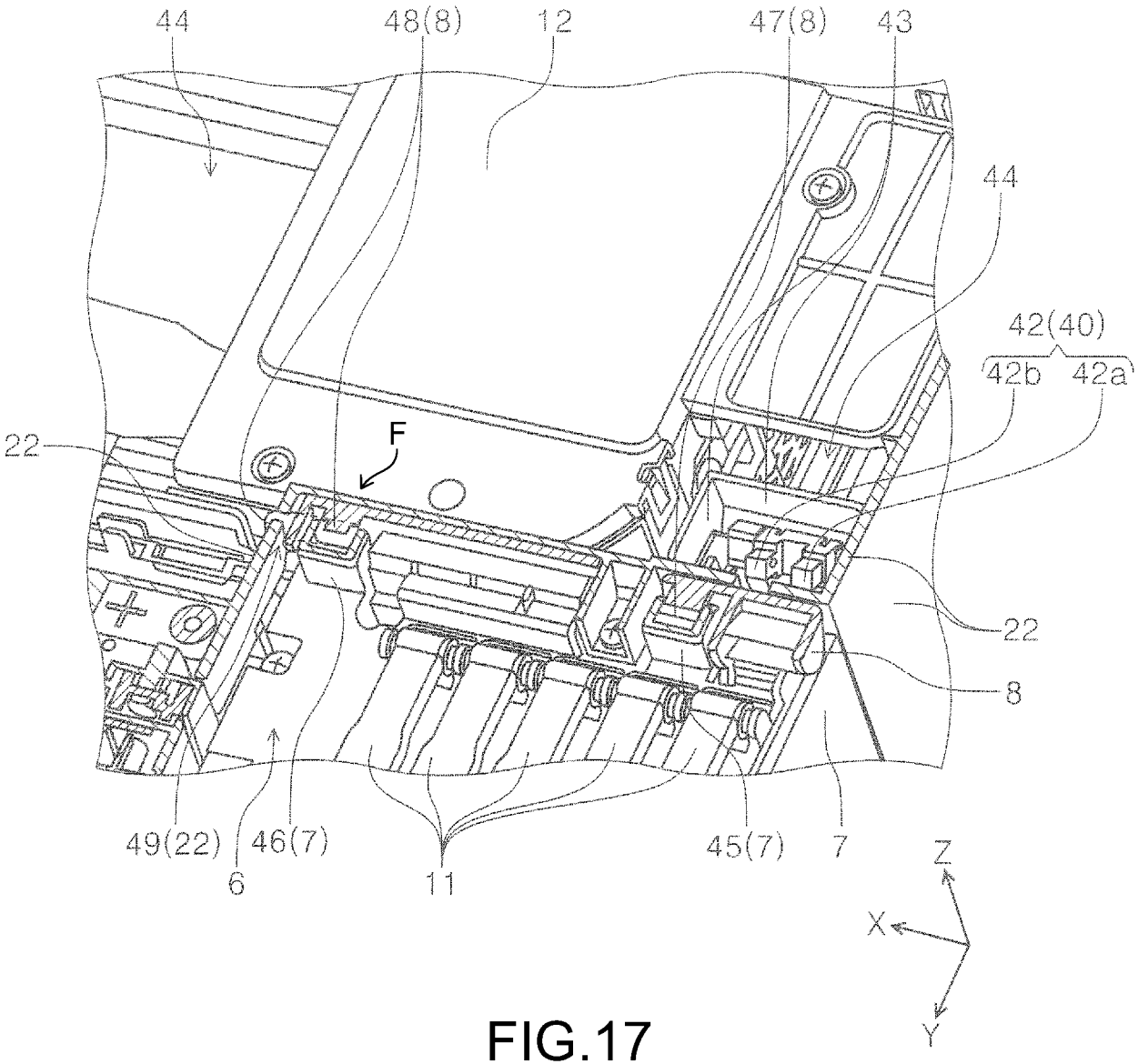
FIG. 17 is a cross-sectional view seen in the direction of arrows E-E in FIG. 14.

Also, in the present working example, at least a portion of the opening and closing detection sensor 40 overlaps with at least a portion of the carriage unit 12 in plan view seen in the device-width direction (X axis) shown in FIG. 11. In other words, the opening and closing detection sensor 40 is located sideward to at least a portion of the carriage unit 12 in the device width direction (X axis), as shown in FIG. 17. As a result of arranging the opening and closing detection sensor 40 in this way, an increase in size in the device-depth direction caused by installing the opening and closing detection sensor 40 can be suppressed.

Furthermore, the specific configuration of the opening and closing detection sensor 40 will be described. The opening and closing detection sensor 40 includes a detection target portion 41 (FIG. 13) that is displaced according to the opening and closing of the ink tank cover 8 and a detection portion 42 that detects the displacement of the detection target portion 41. The detection target portion 41 is provided as a protrusion that protrudes on an opposite side to the ink tank cover 8 relative to the pivoting shaft 32 of the ink tank cover 8, as shown in FIG. 13, and pivots according to the opening and closing of the ink tank cover 8 (refer also to FIG. 16) with the pivoting shaft 32 of the ink tank cover 8 as the shaft.

In the present working example, the detection portion 42 is a photosensor, and includes a light-emitting portion 42*b* that emits light toward a light-receiving portion 42*a* and the light-receiving portion 42*a* that receives light emitted from the light-emitting portion 42*b* (FIGS. 15 and 17). Note that, in the present working example, the light-receiving portion 42*a* is located in the −X-axis direction relative to the light-emitting portion 42*b*, but the positional relationship between the light-receiving portion 42*a* and the light-emitting portion 42*b* may be reversed.

The detection target portion 41 is configured to, in a state in which the ink tank cover 8 is closed, be located between the light-receiving portion 42*a* and the light-emitting portion 42*b* so as to block light that is emitted from the light-emitting portion 42*b* toward the light-receiving portion 42*a*, as shown in FIG. 15, and in a state in which the ink tank cover 8 is opened, be located outside the position between the light-receiving portion 42*a* and the light-emitting portion 42*b* such that the light-receiving portion 42*a* receives light emitted from the light-emitting portion 42*b*, as shown in FIG. 16. Also, an unshown control unit determines that the ink tank cover 8 is in a closed state when the light-receiving portion 42*a* does not receive light, and the ink tank cover 8 is in an opened state when the light-receiving portion 42*a* receives light.

Also, the detection portion 42 (light-receiving portion 42*a* and light-emitting portion 42*b*) is distanced from a space 44 (refer also to FIG. 6) in which ink is to be ejected by the recording head 20, with a wall 43 that surrounds the detection portion 42, as shown in FIG. 15. The space 44 (FIG. 6) in which ink is to be ejected by the recording head 20 is a region that occupies most of the inside of the device body 2 including the region in which the carriage unit 12 moves. As a result of providing the wall 43 between the space 44 in which ink is to be ejected by the recording head 20 and the detection portion 42, the risk of ink mist that is generated when ink is ejected from the recording head 20 adhering to the detection portion 42 can be reduced. Therefore, a reduction in detection accuracy of the detection portion 42 due to the adhesion of mist can be suppressed.

Other Configurations in Ink Tank Portion

Figure 18:
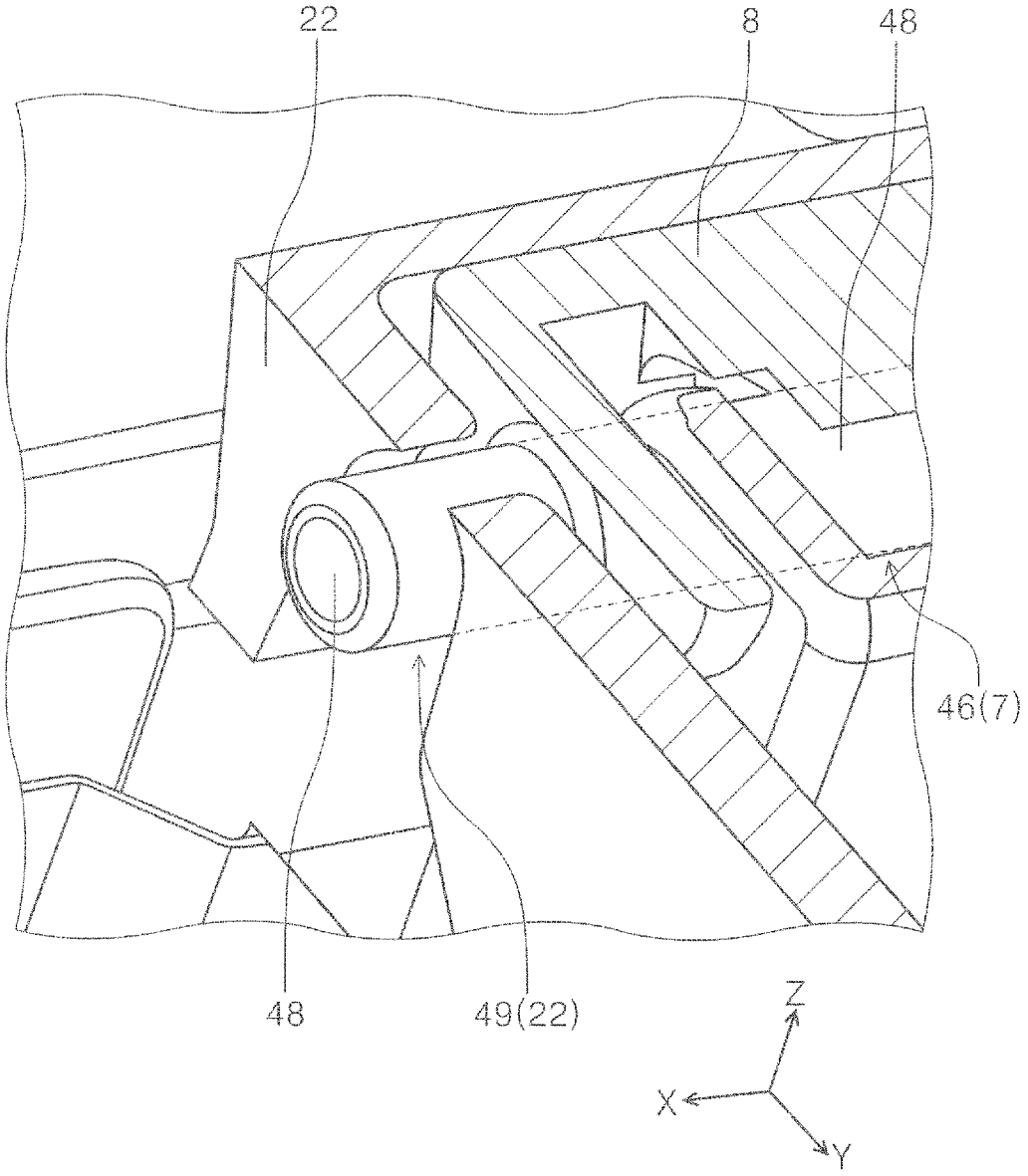
FIG. 18 is an enlarged view of a portion F in FIG. 17 seen in a different angle.
Figure 19:
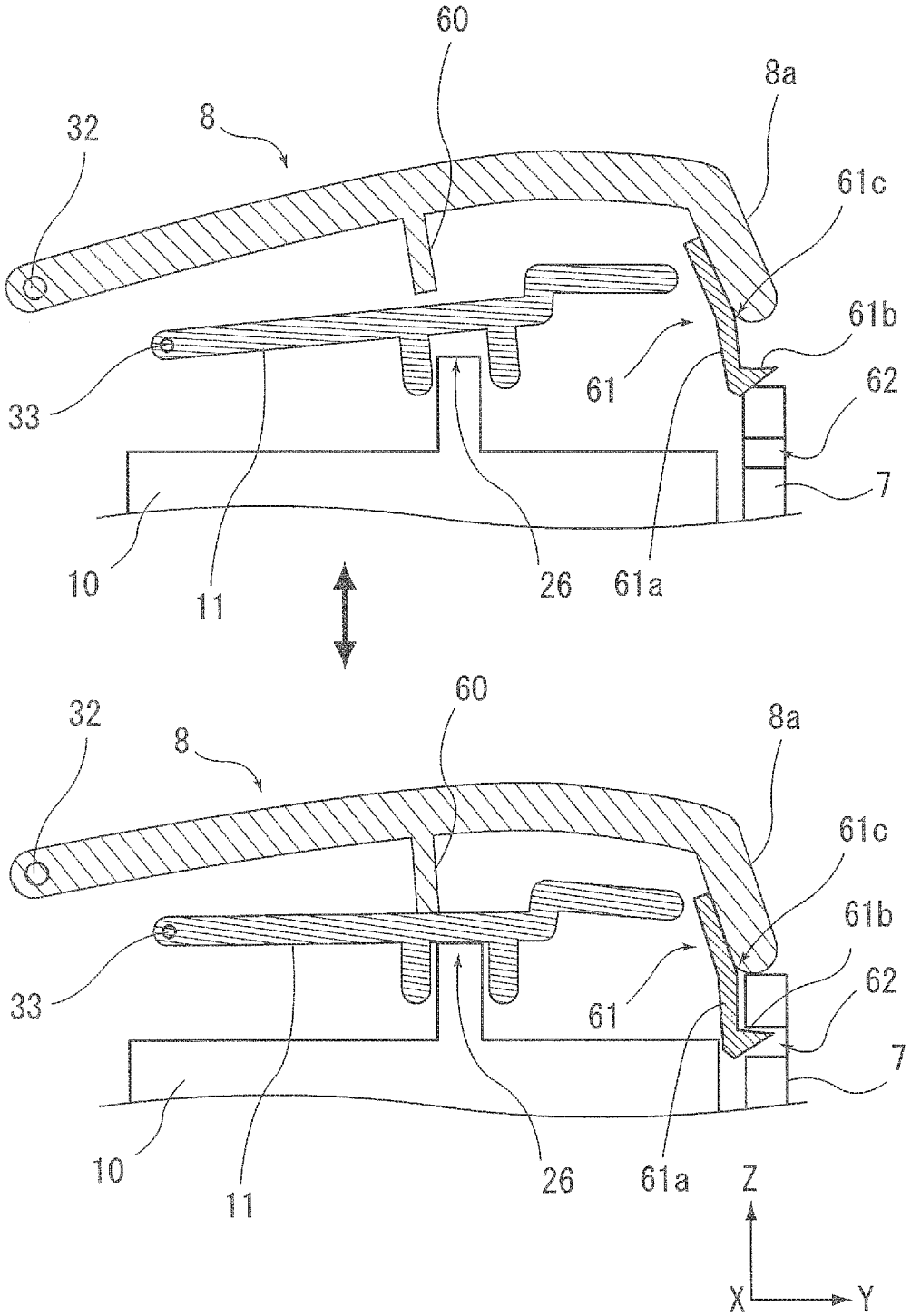
FIG. 19 is a diagram illustrating a configuration of the ink tank cover.

Hereinafter, other configurations in the ink tank portion 6 will be described with reference to FIGS. 17 to 19. FIG. 17 is a cross-sectional view seen in the direction of arrows E-E in FIG. 14. FIG. 18 is an enlarged view of a portion F in FIG. 17 seen in a different angle. FIG. 19 is a diagram illustrating a configuration of the ink tank cover.

Attachment Configuration of Ink Tank Cover

The ink tank cover 8 (refer to FIG. 16) is configured such that a shaft 47 and a shaft 48 that are respectively provided at end portions of the pivoting shaft 32 in the X-axis direction are respectively attached to a bearing 45 and a bearing 46 that are provided in the first casing 7 so as to pivot relative to the first casing 7.

Also, at least one of the shafts (shaft 48 in the present working example) of the shaft 47 and the shaft 48 that constitute the pivoting shaft 32 of the ink tank cover 8 is attached to both the bearing 46 provided in the first casing 7 and a bearing 49 (FIGS. 17 and 18) provided in the second casing 22.

As a result of at least the shaft 48, which is one of the shaft 47 and the shaft 48 of the pivoting shaft 32 of the ink tank cover 8, being attached to both the first casing 7 and the second casing 22, wobbling of the ink tank cover 8 attached to the first casing 7 can be reduced.

Other Configurations of Ink Tank Cover

Hereinafter, the configuration of the ink tank cover 8 will be described with reference to FIG. 19.

The injection port cover 11 that seals the ink injection port 26 of the ink tank 10 needs to securely seal the ink injection port 26, and therefore a force may be required to open and close the injection port cover 11. Therefore, if the force of pressing the injection port cover 11 is weak, there may be cases where the injection port cover 11 does not completely cover the ink injection port 26. When the ink tank cover 8 is closed in a state in which the injection port cover 11 is not completely closed, and if the printer 1 is moved without the user noticing that the sealing of the ink injection port 26 by the injection port cover 11 is not complete, for example, there is a risk of the ink inside the ink tank 10 leaking out from the ink injection port 26.

A pressing portion 60 as shown in FIG. 19 may be provided inside the ink tank cover 8 in order to avoid a situation in which the injection port cover 11 is not completely closed and the sealing of the ink injection port 26 by the injection port cover 11 is incomplete.

When the ink tank cover 8 is closed (lower illustration in FIG. 19) relative to the first casing 7 in a state in which the injection port cover 11 is not completely closed (upper illustration in FIG. 19), the pressing portion 60 of the ink tank cover 8 presses the injection port cover 11 using the force with which the ink tank cover 8 was closed so as to close the injection port cover 11. The pressing portion 60 is desirably provided in the ink tank cover 8 in the vicinity of a position of the injection port cover 11 corresponding to the ink injection port 26.

As a result of the ink tank cover 8 including the pressing portion 60, the injection port cover 11 can be securely closed in conjunction with the closing operation of the ink tank cover 8. Therefore, the risk of the sealing of the ink injection port 26 by the injection port cover 11 remaining incomplete can be reduced.

Also, the ink tank cover 8 is provided with a fixing member 61 that fixes the ink tank cover 8 that has been closed relative to the first casing 7 so as to not open with a small external force on a free end side distanced from the pivoting shaft 32.

The fixing member 61 includes a flat spring 61*a* and an engagement portion 61*b* provided at a leading end of the flat spring 61*a*, and the first casing 7 is provided with an engaged portion 62 with which the engagement portion 61*b* engages when the ink tank cover 8 is closed. The flat spring 61*a* can undergo elastic deformation such that the leading end side (engagement portion 61*b*) moves in the −Y-axis direction with a supporting point 61*c* acting as a fulcrum.

When the state shifts from the state in which the engagement portion 61*b* is located above the first casing 7 and the ink tank cover 8 is open, as shown in the upper illustration in FIG. 19, to a state in which the ink tank cover 8 is closed relative to the first casing 7, as shown in the lower illustration in FIG. 19, the flat spring 61*a* elastically deforms in the −Y-axis direction, and the engagement portion 61*b* enters the inside of the first casing 7. When the ink tank cover 8 is completely closed, the engagement portion 61*b* engages with the engaged portion 62, and the ink tank cover 8 is fixed to the first casing 7.

As a result of the ink tank cover 8 being provided with the fixing member 61, a configuration can be realized in which the ink tank cover 8 that has been closed relative to the first casing 7 is not easily opened.

Also, at the time of closing the ink tank cover 8, when the engagement portion 61*b* engages with the engaged portion 62 after the flat spring 61*a* has elastically deformed and the engagement portion 61*b* has entered into the inside of the first casing 7, the elastic deformation of the flat spring 61*a* returns to its original state, and as a result, a user can feel a so-called clicking feeling because the user can physically feel the returning force and a sound is generated. Accordingly, the user can easily recognize that the ink tank cover 8 has been closed.

Note that the fixing member 61 can be attached to the ink tank cover 8 as a separate member as shown in FIG. 19, but can also be integrally formed with the ink tank cover 8 that is formed using a resin material or the like. A metal material, other than the resin material, can be used as the material for forming the fixing member 61.

Also, the ink tank cover 8 may be configured to include one of the pressing portion 60 and the fixing member 61.

Note that the invention is not limited to the embodiment described above, and various modifications can be made within the scope of the invention described in the patent claims. It goes without saying that such modifications are included in the scope of the invention.

What is claimed is:

1. A liquid ejection device comprising:

a device body including a liquid ejection unit that ejects a liquid;

a first opening and closing body that closes and opens at least a portion of an upper portion of the device body;

a plurality of liquid container portions that are provided in the device body, each contain the liquid to be supplied to the liquid ejection unit, and each include an injection port through which the liquid can be injected from a liquid supply container; and a second opening and closing body that opens and closes a portion above the injection port, wherein at least one of the plurality of injection ports is covered by the first opening and closing body when the first opening and closing body is closed, and the other injection ports are not covered by the first opening and closing body when the first opening and closing body is closed, wherein the plurality of liquid container portions are arranged in a device side portion on a device front surface side, and a first part, which covers a side surface of the plurality of liquid container portions, of a casing that constitutes an exterior of the device body protrudes sideward relative to a second part on a device rear side relative to the first part, and an opening and closing detection sensor that detects opening and closing of the second opening and closing body is arranged between the first part and the second part in a device-width direction.

2. The liquid ejection device according to claim 1, wherein the second opening and closing body includes a contact portion that can come into contact with the first opening and closing body, and abuts against the first opening and closing body at the contact portion when the second opening and closing body is in an open state such that the first opening and closing body is kept at an opening angle so as to be distanced from the liquid supply container that has been attached to the injection port.

3. The liquid ejection device according to claim 2, further comprising third opening and closing bodies that are respectively provided to the plurality of injection ports and close and open the respective injection ports, wherein the third opening and closing bodies in a state of having closed the respective injection ports are covered by the second opening and closing body in a closed state.

4. The liquid ejection device according to claim 3, wherein at least a portion of a pivoting region of the second opening and closing body, which is pivotable, and a portion of a pivoting region of the third opening and closing bodies, which are also pivotable, overlap at least a portion of a pivoting region of the first opening and closing body, which is pivotable, when seen in a shaft direction of a pivoting shaft of the first opening and closing body.

5. The liquid ejection device according to claim 1, further comprising a carriage unit that includes the liquid ejection unit and moves in the device-width direction, wherein at least a portion of the opening and closing detection sensor overlaps at least a portion of the carriage unit in plan view seen in the device-width direction.

6. The liquid ejection device according to claim 1, wherein the opening and closing detection sensor includes a detection target portion that is displaced according to the opening and closing of the second opening and closing body, and a detection portion that detects the displacement of the detection target portion, and the liquid ejection device further includes a wall between a space in which a liquid is to be ejected by the liquid ejection unit and the detection portion.

7. The liquid ejection device according to claim 1, wherein the first opening and closing body is a scanner unit that reads a document.

8. A liquid ejection device comprising:

a device body including a liquid ejection unit that ejects a liquid;

a first opening and closing body that closes and opens at least a portion of an upper portion of the device body;

a second opening and closing body that opens and closes a portion above the injection ports;

a plurality of third opening and closing bodies that are respectively provided to the plurality of injection ports and close and open the respective injection ports; and a plurality of liquid container portions that are provided in the device body, each contains the liquid to be supplied to the liquid ejection unit, and each includes an injection port through which the liquid can be injected from a liquid supply container, wherein at least one of the plurality of injection ports is covered by the first opening and closing body when the first opening and closing body is closed, and the other injection ports are not covered by the first opening and closing body when the first opening and closing body is closed, wherein the third opening and closing bodies in a state of having closed the respective injection ports are covered by the second opening and closing body in a closed state, wherein the second opening and closing body and each third opening and closing body are configured to be pivotable until respective opening angles are reached at which they can stand on their own, and each third opening and closing body includes an abutting portion that can abut against the second opening and closing body, and as a result of the abutting portion abutting against the second opening and closing body that is in a state of being open and standing on its own, the third opening and closing body is open and stands on its own and is distanced from the liquid supply container that has been connected to the injection port.

9. A liquid ejection device comprising:

a device body including a liquid ejection unit that ejects a liquid;

a first opening and closing body that closes and opens at least a portion of an upper portion of the device body;

a plurality of liquid container portions that are provided in the device body, each contain the liquid to be supplied to the liquid ejection unit, and each include an injection port through which the liquid can be injected from a liquid supply container; and a second opening and closing body that opens and closes a portion above the injection port, wherein at least one of the plurality of injection ports is covered by the first opening and closing body when the first opening and closing body is closed, and the other injection ports are not covered by the first opening and closing body when the first opening and closing body is closed, wherein a corresponding injection port cover is removably attached to each of the injection ports, wherein an ink tank cover is removably disposed overtop of the plurality of liquid container portions, and wherein at least a portion of a pivoting region of the ink tank cover, which is pivotable, and a portion of a pivoting region of one or more of the injection port covers, which are also pivotable, overlap at least a portion of a pivoting region of the first opening and closing body, which is pivotable, when seen in a shaft direction of a pivoting shaft of the first opening and closing body, wherein the plurality of liquid container portions are arranged in a device side portion on a device front surface side, and a first part, which covers a side surface of the plurality of liquid container portions, of a casing that constitutes an exterior of the device body protrudes sideward relative to a second part on a device rear side relative to the first part, and an opening and closing detection sensor that detects opening and closing of the second opening and closing body is arranged between the first part and the second part in a device-width direction.

* * * * *